US010569925B2

(12) United States Patent
Bressan et al.

(10) Patent No.: US 10,569,925 B2
(45) Date of Patent: Feb. 25, 2020

(54) PACKAGE AND PROCESS FOR MAKING THE SAME

(71) Applicant: I.G.B. S.r.l., Milan (IT)

(72) Inventors: Alessio Bressan, Varese (IT); Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 0 days.

(21) Appl. No.: 15/907,603

(22) Filed: Feb. 28, 2018

(65) Prior Publication Data

US 2018/0244425 A1 Aug. 30, 2018

(30) Foreign Application Priority Data

Feb. 28, 2017 (IT) ..... 102017000022438

(51) Int. Cl.
*B65D 5/38* (2006.01)
*B65D 75/28* (2006.01)
(Continued)

(52) U.S. Cl.
CPC ..... *B65D 5/38* (2013.01); *B31B 50/624* (2017.08); *B31B 50/734* (2017.08); *B65D 75/28* (2013.01);
(Continued)

(58) Field of Classification Search
CPC ..... B65D 5/38; B65D 75/28; B65D 75/70; B65D 5/0254; B65D 2101/00; B65D 5/10;
(Continued)

(56) References Cited

U.S. PATENT DOCUMENTS 1,253,489 A 1/1918 Houghland
6,491,211 B1 * 12/2002 Evans ..... B65D 5/38 206/532
(Continued)

FOREIGN PATENT DOCUMENTS

GB 335838 A 10/1930
WO WO2009038219 A 3/2009
WO WO2012112538 A 8/2012

OTHER PUBLICATIONS

Search Report for Italian Application No. IT201700022438, dated Dec. 13, 2017, 7 pages.

*Primary Examiner* — Christopher R Demeree
(74) *Attorney, Agent, or Firm* — Fish & Richardson P.C.

(57) ABSTRACT

A package includes a housing, a container, and a coupling system. The housing defines a first internal volume and includes first lateral walls that define a first through opening further defined by a first edge. The container defines a second internal volume and is configured for housing one or more products. The container includes second lateral walls that define a second through opening further defined by a second edge, the second through opening being configured to permit insertion and withdrawal of the one or more products from the container. The container is adjustable to a first configuration in which the container is at least partially disposed within the housing and a second configuration in which the container is at least partially disposed outside of the first internal volume. The coupling system is configured to secure the container to the housing.

21 Claims, 15 Drawing Sheets

(51) Int. Cl.

| | |
|---|---|
| ***B65D 75/70*** | (2006.01) |
| ***B31B 50/73*** | (2017.01) |
| ***B31B 50/62*** | (2017.01) |
| *B31B 110/35* | (2017.01) |
| *B31B 120/50* | (2017.01) |
| *B31B 120/60* | (2017.01) |

(52) U.S. Cl.
CPC ..... *B65D 75/70* (2013.01); *B31B 2110/35* (2017.08); *B31B 2120/50* (2017.08); *B31B 2120/60* (2017.08); *B65D 2101/00* (2013.01); *B65D 2215/02* (2013.01)

(58) Field of Classification Search
CPC ..... B65D 5/2057; B65D 2583/0468; B31B 50/624; B31B 50/734
USPC ..... 229/102, 125.125, 153, 194, 151, 152, 229/222; 206/807, 267, 313, 531
See application file for complete search history.

(56) References Cited

U.S. PATENT DOCUMENTS

| | | | | |
|---|---|---|---|---|
| 7,810,640 | B2 * | 10/2010 | Weston | B65D 5/38 206/483 |
| 8,235,204 | B2 * | 8/2012 | Loughman | B65D 5/38 206/1.5 |
| 9,475,605 | B2 * | 10/2016 | Everett | B65D 5/38 |
| 10,189,625 | B2 * | 1/2019 | Bressan | B65D 5/0254 |

* cited by examiner

FIG.1
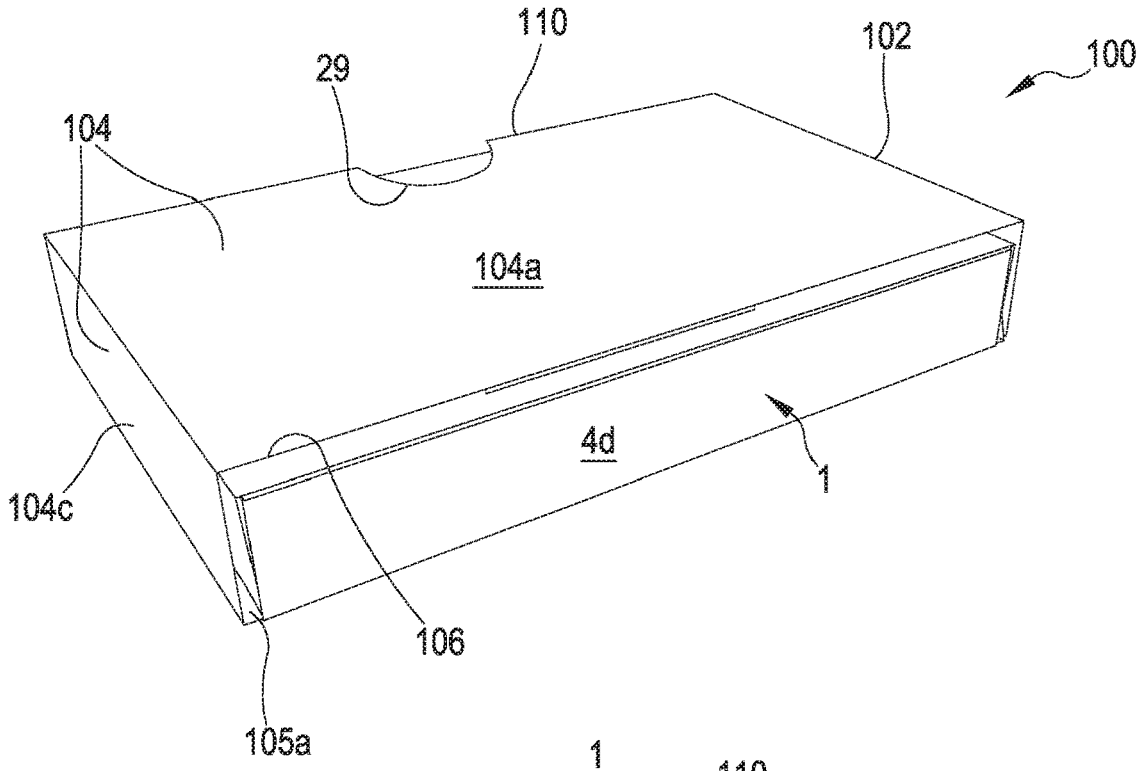
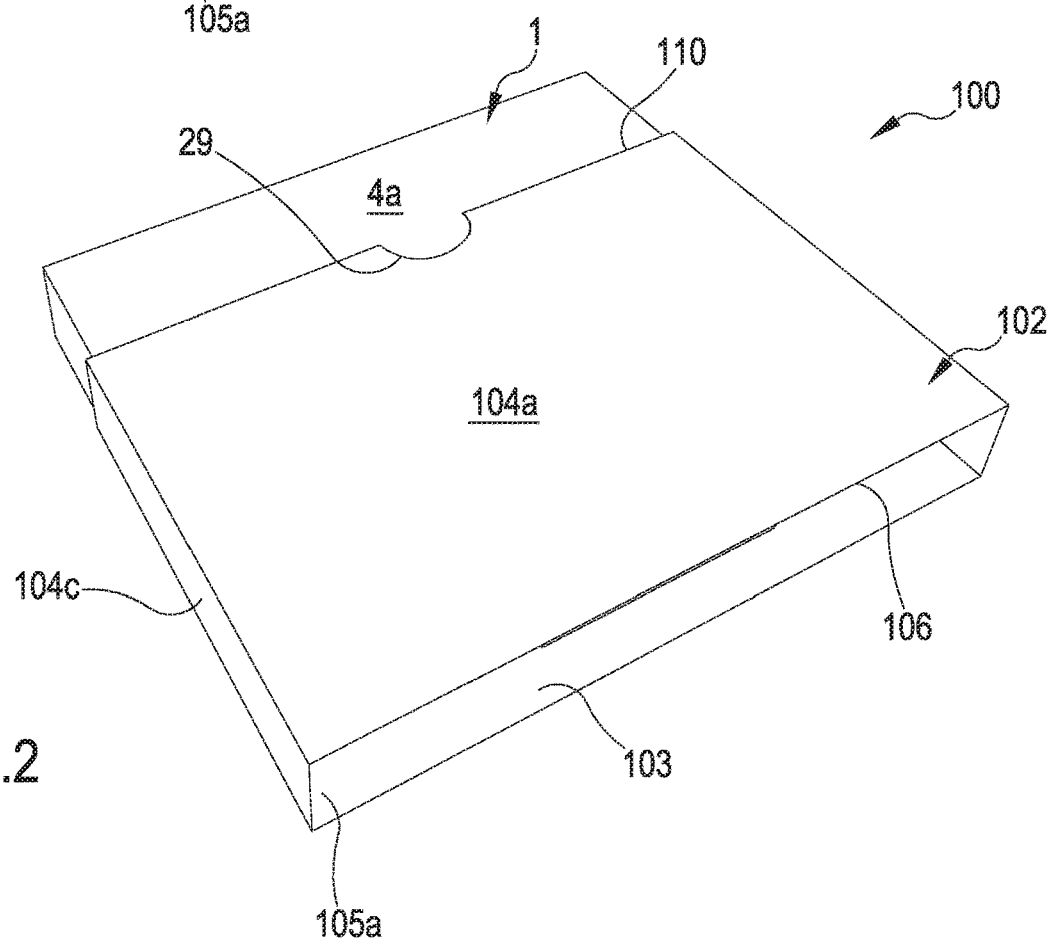
FIG.2

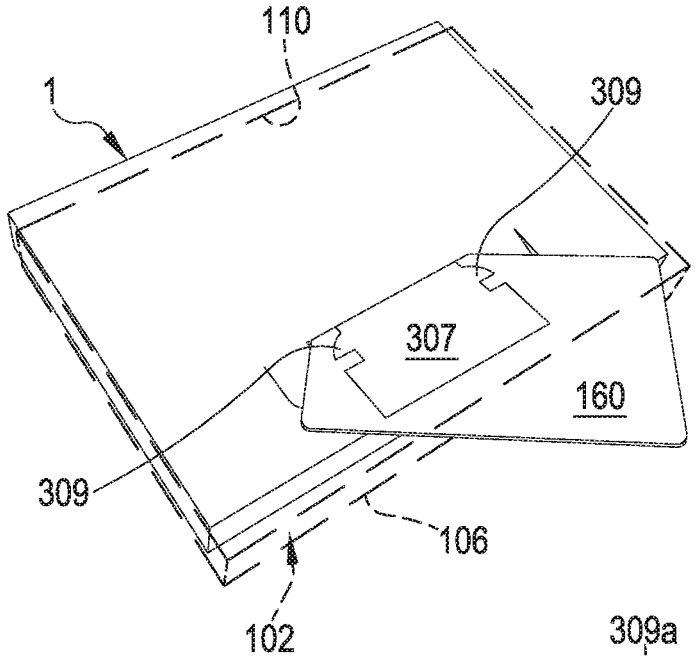
FIG.17
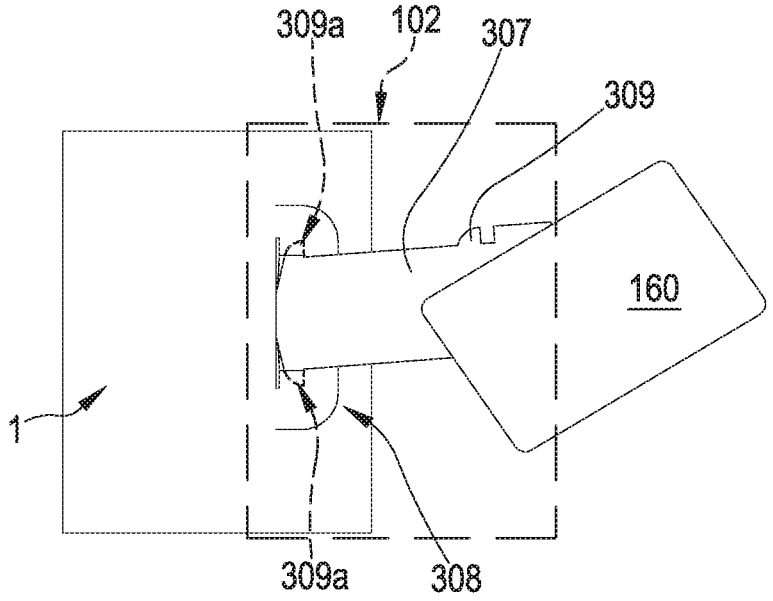
FIG.18
FIG.19
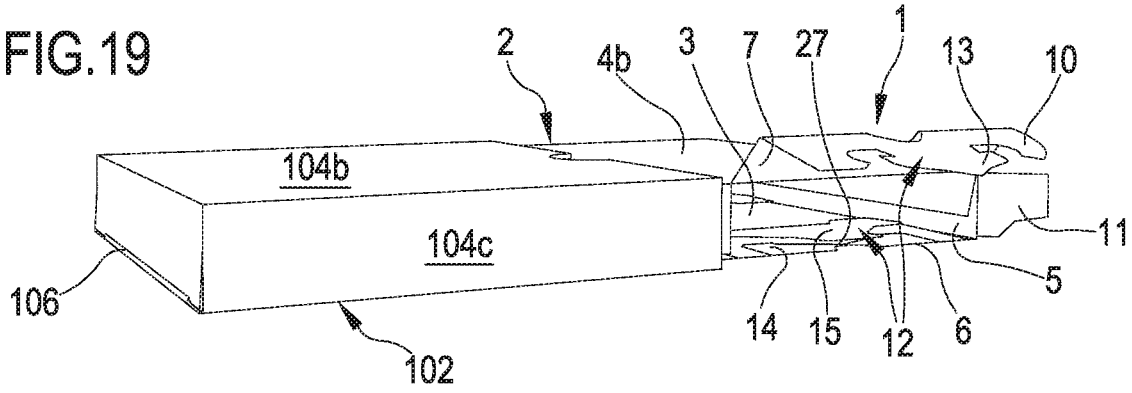

PACKAGE AND PROCESS FOR MAKING THE SAME

CROSS REFERENCE TO RELATED APPLICATIONS

This patent application claims priority under 35 U.S.C § 119 to Italian Patent Application No. 102017000022438, filed Feb. 28, 2017, the entire contents of which are incorporated herein by reference.

TECHNICAL FIELD

This disclosure relates to packages and related processes for making such packages. Such packages can be used in the pharmaceutical and cosmetic fields. Additionally, the packages can be advantageously be used in the food field for the packaging of food (e.g., confectionery products) and in the cigar and cigarette field for the packaging thereof. Such packages can be useful in all the fields that require preventing children from opening such packages for safety reasons. Such packages can also be used all fields that require evidence a package tampering.

BACKGROUND

Box-shaped packages are available on the market which are configured to be easily opened and closed reversibly. These packages are now used for containing a wide range of products, such as drugs, cosmetics, food products (e.g., confectionery products), cigars, and cigarettes.

Generally, such packages include a container of paper material having two accesses longitudinally opposed to one another. At each access, the container includes a tab movable by rotation with respect to the same container between an open condition, in which the tab is spaced from the access, and a closed condition in which the tab is inserted into the container and obstructs the access. The tab, in the closed condition of the container, has an "L" shape in which an engagement portion of the same tab inside the container is facing and in contact with a front wall of the latter.

The package may include one or more packing materials—which can be inserted and removed from the container—inside which the products are arranged (the packing material can for example include a blister carrying a plurality of pharmaceutical products) or the products are housed directly in the package (without packing material): the "loose" products are placed in the package, like for example is currently done with cigars and cigarettes.

It should however be noted that these types of packages can be easily opened by children who can therefore come into contact with elements that are potentially harmful to them. It should also be noted that these packages allow the total extraction of the product (for example blisters for the containment of drugs, plastic tubes for cosmetics, etc.) from the package: once the product has been extracted, there may be the risk that it will be forgotten out of the box, with the consequent risk that children may come into contact with elements that are potentially harmful to them.

In some embodiments, a package includes a case made of paper material having a box shape; inside the case there is a plastic tray which retains at its interior one or more blisters to contain a plurality of products.

The case has a classic opening and closing mechanism (movable and "L" shaped tab inoperable in the package); in the closed condition of the package, an engagement portion of the tab extends parallel to a front wall of the same container.

Unlike the previous solutions, the case of the latter package has, at opposite longitudinal lateral walls, two slits which are also arranged along a diagonal of the case itself. The tray includes two protrusions suitable for inserting into the respective slits of the case: in the condition in which the tray is housed in the case, the engagement of the protrusions with the slits prevents the extraction of the same tray by just a pulling action thereof. If one wants to remove the tray from the container, the protrusions must be pressed in such a way as to push them towards the inside of the container and make it disengage from the slits; at this point, the tray can be removed.

This latter solution has an opening mechanism which requires a particular handle and handling of the package, a condition which makes it difficult to open it by children. However, the package described above is not exempt from limitations and drawbacks. For example, the structure of the package is rather complex, a condition that negatively affects production and product costs: in order to be able to function correctly, the package requires the shaped plastic tray. Moreover, the particular structure of the tray requires a substantial modification of the existing packaging plants and used for the production of standard-type packages; this modification requires, in particular, the insertion of a new closing line, the insertion of special machines for forming the tray with a considerable increase in the process costs and therefore in the final product.

SUMMARY

The object of the present invention therefore is to substantially solve the drawbacks and/or limitations of conventional packages.

A first object of the present invention is to provide a package having a simple and compact structure and at the same time able to effectively inhibit access to children, preventing the total extraction of the products contained herein. It is also an object of the present invention to provide a package having a highly flexible structure in its use. A further object of the present invention is to provide a package which advantageously prevents access to a child, having a stable structure able to ensure its integrity following multiple opening and closing of the container itself.

It is also an object of the present invention to provide a package which can effectively ensure that tampering is evidenced at a first opening of the package itself, also to blind people.

An additional object of the present invention is to provide a relative package which can be quickly manufactured with low production costs. In particular, it is an object of the invention to provide a package which does not require the modification of already existing plants used for the production of standard-type packages, so as to adapt them easily and cost-effectively to the production of the package object of the present invention. It is then an object of the present invention to provide a rapid and highly flexible process which can therefore minimize production costs related to the manufacture of the package. These and yet other objects, which will become more apparent from the following description, are substantially achieved by a package and a related manufacturing process according to what is expressed in one or more of the accompanying claims and/or the following aspects, taken alone or in any combination with each other or in combination with any one of the appended claims and/or in combination with any of the other aspects or features described below.

In a 1st aspect, a package (100) is provided including:

at least one case (102) of sheet material, particularly of paper sheet material, defining an internal volume (103), the case (102) having a predetermined number of lateral walls (104) defining at least one through opening (105) delimited by a free edge (110), at least one container (1) of sheet material, particularly of paper sheet material, defining an internal volume (3), said container (1) being configured for housing at least one product, said container (1) having a predetermined number of lateral walls (4) defining at least one respective opening (5) delimited by a respective free edge (6), said opening (5) of the container (1) being configured for enabling to insert and withdraw the product from the container (1), said container (1) being at least configurable between:

a first operative position, wherein the container itself (1) is at least partially housed into the case (102), wherein—in the first operative position—the opening (5) of the container (1) is at least partially defined inside the internal volume (103) of the case (102), which—in such first operative position—prevents the product from being inserted and withdrawn through said opening (5) of the container (1), a second operative position wherein the container (1) itself is at least partially disposed outside the internal volume (103) of the case (102), wherein—in the second operative position—the opening (5) of the container (1) is defined outside the internal volume (103) of the case (102) and is adapted to enable to insert and withdraw the product from the container (1), said container (1) being configured for switching from the first to the second operative conditions through the through opening (105) of the case (102), at least one coupling system (301) of sheet material, particularly of paper sheet material, configured for constraining the container (1) to the case (102), said coupling system (301) including:

at least one first coupling portion (307) borne by one between said case (102) and container (1), at least one second coupling portion (308) borne by the other between said container (1) and case (102), said second coupling portion (308) being engaged—at least in the first operative position of the container (1)—to the first coupling portion (307), for preventing said container (1) from switching from the first to the second operative positions.

In a 2nd aspect according to the preceding aspect, the coupling system (301) further includes at least one thrusting element (313) active on at least one between the first (307) and second coupling portions (308), said thrusting element (313) being configured for keeping stable the engagement between the first and second coupling portions (307, 308) at least during the first operative position of the container (1).

In a 3rd aspect according to the preceding aspect, the thrusting element (313) is distinct from the first and the second coupling portion (307, 308).

In a 4th aspect according to any one of the preceding aspects, the first coupling portion (307) includes a protrusion emerging from a lateral wall of at least one between the case (102) and the container (1) in the internal volume (103) of said case (102).

In a 5th aspect according to the preceding aspect, the thrusting element (313) is configured to act in thrust on the protrusion of the first coupling portion (307).

In a 6th aspect according to the 4th or 5th aspect, the thrusting element (313) is configured to push the protrusion of the first coupling portion (307) towards the second coupling portion (308), optionally according to a direction entering the container (1).

In a 7th aspect according to any one of the aspects 4th to 6th, the protrusion of the first coupling portion (307) emerges from a lateral wall of at least one between the case (102) and the container (1) along a predetermined extension direction (D).

In an 8th aspect according to the preceding aspect, the thrusting element (313) is configured to act in thrust on the protrusion along a transverse direction, particularly substantially orthogonal, to the predetermined extension direction (D) of the protrusion.

In a 9th aspect according to any one of the preceding aspects, the first coupling portion (307) includes at least one lateral stop element (309) adapted to define an undercut stably engaged, in the first operative position of the container (1), with the second coupling portion (308).

In a 10th aspect according to any one of the preceding aspects, the first coupling portion (307) includes at least two lateral stop elements (309) opposed to each other, in particular emerging from lateral edges opposed to each other of the first coupling portion (307).

In an 11th aspect according to the preceding aspect, said lateral edges (edges from which the two stop elements emerge) are symmetrical with respect to the extension direction (D) of the first coupling portion.

In a 12th aspect according to any one of aspects 9th to 11th, each of said stop elements (309) defines a respective undercut, firmly engaged, in the first operative position of the container (1), to the second coupling portion (308).

In a 13th aspect according to any one of the aspects 4th to 12th, the lateral stop element (309), in particular each lateral stop element (309), defines a lateral protuberance of the protrusion of the first coupling portion (307).

In a 14th aspect according to the preceding aspect, said lateral protuberance emerges from the protrusion of the first coupling portion (307) according to a transverse direction, particularly orthogonal, to the predetermined extension direction (D) of said protrusion.

In a 15th aspect according to any one of the aspects 9th to 14th, the lateral stop element (309), in particular each lateral stop element (309), is in one piece with the protrusion of the first coupling portion (307).

In a 16th aspect according to any one of the preceding aspects, the first coupling portion (307) is carried, in particular directly carried, by the case (102).

In a 17th aspect according to any one of the preceding aspects, the second coupling portion (308) is carried, in particular directly carried, by the container (1).

In an 18th aspect according to any one of the preceding aspects, the first coupling portion (307) is in one piece with the case (102).

In a 19th aspect according to any one of the preceding aspects, the second coupling portion (308) is in one piece with the container (1).

In a 20th aspect according to any one of the preceding aspects, the case (102) includes an auxiliary through opening (105*a*) opposite to the through opening (105) of the case (102) itself, said auxiliary through opening (105*a*) being delimited by a free edge (106), the first coupling portion (307) being connected to the free edge (106) of the auxiliary through opening (105*a*).

In a 21st aspect according to the preceding aspect, the first coupling portion (307), in particular the protrusion, is joined in one piece and folded—with respect to the free edge (106) of the auxiliary through opening (105*a*)—inside the case (102).

In a 22nd aspect according to any one of the preceding aspects, the second coupling portion (308) includes a pocket (314) defined on at least one lateral wall of the case (102) or of the container (1), such pocket is adapted to insertingly receive—at least in the first operative condition of the container (1)—the first coupling portion (307).

In a 23rd aspect according to the preceding aspect, the pocket (314) is delimited by a closure edge (315) adapted to define at least one undercut configured for being stably constrained to the first coupling portion (307)—at least in the first operative position of the container (1)—for preventing the container (1) itself from switching from the first to the second operative position.

In a 24th aspect according to the preceding aspect, the undercut defined by the closure edge (315) abuts, particularly engages, the stop element (309) of the first coupling portion (307) at least during the first operative position of the container (1).

In a 25th aspect according to any one of aspects 22nd to 24th, the second coupling portion (308) includes at least one cut (317) directly communicating with the pocket (314), said cut (317) being configured for enabling to disengage the first (307) and second (308) coupling portions, particularly for enabling the container (1) to switch from the first to the second operative positions of the container (1) itself.

In a 26th aspect according to any one of aspects 22nd to 25th, the pocket (314) is further delimited by a trailing edge (318) directly connected to the closure edge (315), wherein the closure edge (315) has—along a direction normal to an inserting direction of the first coupling portion (307) into the pocket (314)—a predetermined width (L), and wherein the trailing edge (318) has—again along a direction normal to the inserting direction of the first coupling portion (307) into the pocket (314)—a predetermined width (L") greater than the width (L) of the closure edge (315).

In a 27th aspect according to the preceding aspect, the second coupling portion (308) includes two cuts (317) opposed to each other and directly communicating with the pocket (314), said cuts (317) and the pocket (314) delimiting said trailing edge (318).

In a 28th aspect according to any one of the aspects 23rd to 27th, the first coupling portion (307) has—according to a direction orthogonal to the direction of insertion of the same first coupling portion (307) into the pocket (314)—a predetermined maximum width, in particular measured at the lateral stop element (309), greater than the maximum width (L) of the closure edge (315).

In a 29th aspect according to any one of the aspects 23rd to 28th, the cooperation between the lateral stop element (309) of the first coupling portion (307) and the closure edge (315) of the pocket (314) due to a greater width of said lateral stop element (309) with respect to the closure edge (315), defines an undercut to prevent—in the first operative position of the container—the switching of the container (1) from said first operative position to the second operative position.

In a 30th aspect according to any one of the preceding aspects, in the first operative position of the container (1), at least part of the first coupling portion (307), in particular at least part of the lateral stop element (309), is arranged in the internal volume (3) of the container (1).

In a 31st aspect according to any one of the aspects 9th to 30, the lateral stop element (309) of the first coupling portion (307) optionally has—according to a direction orthogonal to the direction of insertion of the same first coupling portion (307) into the pocket (314)—a width greater than a width of the protrusion of the first coupling portion (307) measured not at said stop element (309).

In a 32nd aspect according to any one of the aspects 26th to 31st, the first coupling portion (307) has—according to a direction orthogonal to the direction of insertion of the same first coupling portion (307) into the pocket (314)—a predetermined width, measured at the lateral stop element (309), smaller than the width of the trailing edge (318), in particular slightly smaller than the width of the trailing edge (318).

In a 33rd aspect according to any one of the aspects 26th to 32nd, the closure edge (315) includes:

at least one leading edge (315*a*) opposite to the trailing edge (318), two side edges (315*b*) opposite each other, which directly connect the leading edge (315*a*) to the trailing edge (318).

In a 34th aspect according to any one of the aspects 26th to 33rd, the pocket (314) is only delimited by said closure edge (315) and trailing edge (318).

In a 35th aspect according to any one of aspects 22nd to 34th, the pocket (314) is defined on the lateral wall (4) of the container (1), in particular said pocket (314) is defined on a front lateral wall (4*a*) of the container (1).

In a 36th aspect according to any one of the preceding aspects, the case (102) includes a front lateral wall (104*a*) and a rear lateral wall (104*b*) facing and parallel to each other, the lateral front and rear walls are connected to and distanced from each other by a first and second lateral walls (104*c*, 104*d*) also facing and parallel to each other.

In a 37th aspect according to the preceding aspect, the front (104*a*) and rear walls (104*b*) being distanced from each other by the lateral walls (104*c*, 104*d*).

In a 38th aspect according to aspect 26th or 37th, the first coupling portion (307) is carried by at least one between the front wall (104*a*) and the rear wall (104*b*).

In a 39th aspect according to any one of the aspects 36th to 38th, the first coupling portion (307) emerges from the front (104*a*) and/or rear wall (104*b*) into the internal volume (103) of the same case (102).

In a 40th aspect according to any one of the preceding aspects, the first coupling portion (307), in particular the protrusion of said first coupling portion (307), is integrally joined to the case (102).

In a 41st aspect according to any one of the aspects 36th to 40th, the first coupling portion (307) is only carried by the front lateral wall (104*a*).

In a 42nd aspect according to any one of the preceding aspects, the container (1) includes a front lateral wall (4*a*) and a rear lateral wall (4*b*) facing and parallel to each other, the front (4*a*) and rear (4*b*) lateral walls of the container (1) being connected to each other and spaced by means of a first and a second lateral wall (4*c*, 4*d*) which are also facing and parallel to one another.

In a 43rd aspect according to the preceding aspect, the front and rear lateral walls (4*a*, 4*b*) of the container (1) are respectively facing the front (104*a*) and rear (104*b*) lateral wall of the case (102), at least during the first operative position of the container (1).

In a 44th aspect according to the 42nd or 43rd aspect, the first connecting lateral wall (4*c*) of the container (1)—at least in the first operative position of the latter—is arranged at the through opening (105) of the case (102).

In a 45th aspect according to any one of aspects 42nd to 44th, the second connecting lateral wall (4*d*) of the container (1)—at least in the first operative position of the latter—is arranged at the auxiliary through opening (105*a*) of the case (102).

In a 46th aspect according to any one of the preceding aspects, the container (1) has an outer delimitation surface which is substantially counter-shaped to an inner delimitation surface of the internal volume (103) of the case (102).

In a 47th aspect according to any one of aspects 42nd to 46th, the second coupling portion (308) is defined on the front wall (4*a*) of the container (1), said second coupling portion (308)—at least during the first operative position of the container (1)—facing the front wall (104*a*) of the case (102).

In a 48th aspect according to any one of aspects 42nd to 47th, the pocket (314) is defined on the front lateral wall (4*a*) of the container (1).

In a 49th aspect according to any one of the aspects 36th to 48th, the pocket is—at least during the first operative position of the container (1)—facing the front lateral wall (104*a*) of the case (102).

In a 50th aspect according to any one of the aspects 42nd to 49th, the thrusting element (313) is borne, particularly directly borne, by the front lateral wall (4*a*) of the container (1).

In a 51st aspect according to any one of the aspects 42nd to 50th, the thrusting element is integrally joined to the front lateral wall of the container.

In a 52nd aspect according to any one of the preceding aspects, the thrusting element is folded in the internal volume of the container (1).

In a 53rd aspect according to any one of the aspects 26th to 52nd, the thrusting element (313) emerges from the trailing edge (318) according to a direction transversal to the insertion direction of the first coupling portion (307) in the pocket (314) of the container (1).

In a 54th aspect according to any one of the aspects 26th to 53rd, the thrusting element (313) is folded around the trailing edge (318) in the internal volume (3) of the container (1).

In a 55th aspect according to any one of the aspects 26th to 54th, the thrusting element (313) is directly connected to the trailing edge (318), in particular integrally joined to said trailing edge (318), and emerges from the latter inside the container (1).

In a 56th aspect according to any one of the aspects 26th to 55th, the thrusting element (313) emerges from the trailing edge (318) according to a direction transversal to the insertion direction of the first coupling portion (307) in the pocket (314).

In a 57th aspect according to any one of the aspects 26th to 56th, the thrusting element (313) is folded around the trailing edge (318) towards the interior of the container (1).

In a 58th aspect according to any one of the aspects 26th to 57th, the thrusting element (313) includes at least one protrusion emerging from the trailing edge (318) at least partly delimiting the pocket (314).

In a 59th aspect according to any one of the preceding aspects, the package includes at least one slit (150)—defined between at least a lateral wall (104) of the case (102) and at least one lateral wall (4) of the container (1)—which is configured to allow, at least during the first operative position, the insertion of at least one opening device (160) adapted to disengage the first and second coupling portion (307, 308) in order to allow the switching of the container (1) from the first to the second operative position.

In a 60th aspect according to the preceding aspect, the package includes at least one opening device (160) configured to be inserted at least partially, at least in the first operative position of the container (1), through the slit (150) and interposed between the first and second coupling portion (307, 308) to allow disengagement thereof, the opening device (160) being configured—as a result of its partial insertion into the slit (150)—to allow the container (1) to switch from the first to the second operative position.

In a 61st aspect according to the preceding aspect, the opening device (160) is made of sheet material, in particular a paper sheet.

In a 62nd aspect according to any one of the aspects 59th to 61st, the slit (150) is defined between the front wall (104*a*) of the case (102) and the front wall (4*a*) of the container (1).

In a 63rd aspect according to any one of the aspects 59th to 62th, the slit (150) extends throughout the development of the front lateral wall (104*a*) of the case (102).

In a 64th aspect according to any one of the aspects 9th to 63rd, the first coupling portion (307) includes at least one auxiliary lateral stop element (309*a*)—spaced from the stop element (309) of the first coupling portion (307) itself—adapted to define an auxiliary undercut stably engageable—in the second operative position of the container (1), with the second coupling portion (308), for preventing said container (1) from being completely extracted from the case (102).

In a 65th aspect according to any one of the preceding aspects, in the second operative position, the container (1) is at least partly disposed inside the internal volume (103) of the case (102).

In a 66th aspect according to the 64th or 65th aspect, the first coupling portion (307) includes at least two auxiliary lateral stop elements (309*a*) opposing each other, in particular emerging from opposite lateral edges of the first coupling portion (307), each of which defines a respective auxiliary undercut stably engaged, in the second operative position of the container (1), to the second coupling portion (308).

In a 67th aspect according to any one of the aspects 64th to 66th, the auxiliary lateral stop element (309*a*), in particular each auxiliary lateral stop element (309*a*), defines a lateral protuberance of the protrusion of the first coupling portion (307), said lateral protuberance emerging from the protrusion of the first coupling portion (307) according to a transverse direction, particularly orthogonal, to the predetermined extension direction (D) of said protrusion.

In a 68th aspect according to any one of the aspects 64th to 67th, the auxiliary lateral stop element (309*a*), in particular each auxiliary lateral stop element (309*a*), is in one piece with the protrusion of the first coupling portion (307).

In a 69th aspect according to any one of the aspects 64th to 68th, the protrusion of the first coupling portion (307) extends longitudinally between a base portion (311) and a head portion (312), wherein the lateral stop element (309) is defined at the base portion (311) of the protrusion while the auxiliary lateral stop member (309*a*) is defined at the head portion (312) of the same protrusion.

In a 70th aspect according to any one of the preceding aspects, the container (1) defines an internal volume (3) adapted to receive one or more products, wherein said container (1) includes at least one housing defined at at least one lateral wall of the container (1) and developed at least in part in the internal volume (3) of said container (1), said housing being configured to contain at least one product.

In a 71st aspect according to any one of the aspects 20th to 70th, the case (102) can include a bottom wall (104*e*) suitable for partly occluding the auxiliary through opening (105*a*). In a 72nd aspect according to any one of the preceding aspects, the container (1) includes at least one closure system (7) of sheet material, particularly of paper sheet material, engaged in correspondence of the free edge (6) of the container, and movable, particularly rotatively movable, with respect to said free edge (6) of the opening (5) of the container (1), the closure system (7) of the container (1) being configured for defining at least one closing condition in which the closure system (7) itself substantially occludes the opening (5) of the container (1) and prevents the communication between the internal volume (3) and the outer environment, the closure system (7) of the container (1) being further configured for defining an opening condition in which the system (7) itself enables the communication between the internal volume (3) and the outer environment.

In a 73rd aspect according to the preceding aspect, the closure system (7) of the container (1) includes at least one closure portion (9) engaged to the free edge (6) of the opening (5) of the container (1), said closure portion (9) being movable, in particular by rotation, with respect to the free edge (6), and including a coupling portion (10) configured to fit, in the closed condition of said closure system (7), in the internal volume (3) of the container (1), the container (1) further including at least one safety device (12) made of sheet material that can be firmly engaged at least partly with at least at one lateral wall (4) of the container (1) and at least partly with the closure system (7) following a first closing condition of the latter, the safety device (12) of the container includes at least one removable portion (15) configured to separate from the same safety device (12) itself following a first opening condition of the closure system (7) of the container, following said first closing condition to show evidence of tampering with the container (1).

In a 74th aspect according to the preceding aspect, the safety device (12) of the container (1) includes:

at least a first coupling portion (13) of the safety system (12) of the container (1), at least a second coupling portion (14) engaged to at least one lateral wall of the container (1) and configured to cooperate with said first safety coupling portion (13) of the safety device (12), said first and second coupling portion (13, 14) of said safety device (12) being configured to engage firmly with each other during a first closed condition of the closure system (7), the first and/or the second coupling portion (13, 14) of the safety device (12) of the container (1) having at least one removable portion (15) configured to separate from the safety device (12) following a first opening condition of the closure system (7)) of the container (1) following said first closed condition, to show evidence of tampering with the latter, wherein the second coupling portion (14) of the safety device (12) is arranged in the internal volume (3) of the container (1), in particular lying substantially in a plane parallel to one of the lateral walls of the latter, in the closed condition of the closure system (7), wherein the first coupling portion (13) of the safety device (12) is configured to fit at least partially into the internal volume (3) of the container to firmly engage with the second coupling portion (14) of the same safety device (12).

In a 75th aspect according to the preceding aspect, the second coupling portion (14) of the safety device (12) of the container (1) is directly engaged, in particular integrally joined, with at least a part of the front wall (4*a*) of the container (1).

In a 76th aspect according to the 74th or 75th aspect, the safety device (12) includes a control portion (28) made of sheet material, in particular of paper sheet material, engaged to the front wall (4*a*) of the same container (1) and folded in such a way that the second coupling portion (14) of the safety device (12) is interposed between said front lateral wall (4*a*) and said control portion (28), the container (1) including at least one through recess (27) defined on the front wall (4*a*), said recess (27) being defined at the free edge (6) of the opening (5) of the container (1), wherein the recess (27) is configured to allow visualization from the outside with respect to the container (1) of the removable portion (15) prior to the first opening condition of the container (1), wherein the recess (27) is configured to allow viewing the control portion (28) from the outside with respect to the container (1) after the first opening condition of the container (1).

In a 77th aspect according to the preceding aspect, the case (102) includes at least one through recess (127) defined on the front wall (104*a*), wherein the recess (127) is configured for:

allowing the display, from the outside of the case (102), of the removable portion (15) prior to the condition of first access to the internal volume (3) of the container (1) through the opening (5), allowing the display, from the outside of the case (102), of the control portion (28) following the condition of first access to the internal volume (3) of the container (1) through the opening (5).

In a 78th aspect according to any one of the preceding aspects, the first coupling portion (307) is defined by a tab made of sheet material, in particular of paper sheet material.

In a 79th aspect according to any one of the preceding aspects, the container (1) includes at least one occlusion system (207) including a tab (208) adjacent to the closure system (7) of the container (1), said tab (208) having at least one closing portion (209) carried by the free edge (6) configured to occlude, optionally at least partially, access to the internal volume (3) of the container (1), said tab (208) having at least one fitting portion (210) configured to fit into the internal volume (3) of the container (1).

In an 80th aspect according to the preceding aspect, the occlusion system (207) is arranged at least partly in the internal volume (103) of the case (102) during the first and/or second operative position of the container (1), in particular said occlusion system (207) being entirely arranged in the internal volume (103) of the case (102) in the first operative position of the container (1).

In an 81st aspect according to the 79th or 80th aspect, the closing portion (209) is engaged to the free edge (6) and is movable, in particular by rotation relative to the free edge (6).

In an 82nd aspect according to any one of the aspects 79th to 81st, the closure portion (209) is integrally connected to the free edge (6).

In an 83rd aspect according to any one of the aspects 79th to 82nd, the coupling portion (210) faces a lateral wall (4) of the container (1), in particular the coupling portion (210) faces the front wall (4*a*) of the container (1).

In an 84th aspect according to any one of the preceding aspects, the container (1) includes a first operative portion (31) and a second operative portion (32) respectively configured in such a way that:

the first operative portion (31) is delimited by the free edge (6) adjacent to the opening (5) and by at least one lateral wall (4) of the container (1), said first operative portion (31) being defined inside the internal volume (103) of the case (102) during the first operative position of the container (1), said first operative portion (31) being defined outside the internal volume (103) of the case (102) during the second operative position of the container (1), the second operative portion (32) is delimited by the free edge (6) and by at least one lateral wall (4) of the container (1), said second operative portion (32) being defined inside the internal volume (103) of the case (102) during the first and second operative positions of the container (1).

In an 85th aspect according to the preceding aspect, the first operative portion (31) of the container (1) includes the opening (5) and optionally the closure system (7).

In an 86th aspect according to the 84th or 85th aspect, the second operative portion (32) of the container (1) includes the second coupling portion (308) adapted to receive the insertion of the first coupling portion (307) of the case (102).

In an 87th aspect according to any one of the aspects 84th to 86th, the second coupling portion (308) is defined at the second operative portion (32) of the container (1).

In an 88th aspect according to any one of the aspects 84th to 87th, the thrusting element (313) is defined at the second operative portion (32) of the container (1).

In an 89th aspect according to any one of the preceding aspects, the case (102) includes at least one through recess (29) defined on a lateral wall (104) of the case (102), in particular said through recess (29) being defined at the free edge (110).

In a 90th aspect according to the preceding aspect, the recess (29) is defined on the front and/or rear wall (104*a*, 104*b*) of the case (102) and is configured to allow—at least during the first operative position of the container (1)—the exposure of at least part of the surface of the front and/or rear wall (4*a*, 4*b*) of the container (1), said recess (29) is configured in such a way as to facilitate gripping the container (1) by the end user in the switching of the container (1) from the first to the second operative position.

In a 91st aspect according to any one of the preceding aspects, the second coupling portion (308) includes at least one coupling tab (319), said coupling tab (319) being delimited by the closure edge (315), by a cutting edge (320) and a connecting edge (321).

In a 92nd aspect according to the preceding aspect, the coupling tab (319) is carried by the front wall (4*a*) of the container (1) and connected to the latter by the connecting edge (321), said coupling tab (319) is movable by rotation relative to said connecting edge (321).

In a 93rd aspect according to the 91st or 92nd aspect, the coupling tab (319) is integrally joined to the front wall (4*a*) by the connecting edge (321).

In a 94th aspect, a package is provided including:

at least one case (102) of sheet material, particularly of paper sheet material, defining an internal volume (103), the case (102) having a predetermined number of lateral walls (104) defining at least one through opening (105) delimited by a free edge (110), at least one container (1) made of sheet material, in particular of paper sheet material, defining an internal volume (3), said container (1) being configured for housing at least one product, said container (1) having a predetermined number of lateral walls (4) delimiting at least in part the internal volume of the same container (1), said container (1) having at a least one lateral wall a seat—at least partially defined in the internal volume of the container—suitable for housing at least one product, said container (1) being at least configurable between:

a first operative position, wherein the container itself (1) is at least partially housed into the case (102), wherein—in the first operative position—the seat of the container (1) is at least partially defined inside the internal volume (103) of the case (102), which—in such first operative position—prevents the product from being inserted and withdrawn through said seat of the container (1), a second operative position wherein the container (1) itself is at least partially disposed outside the internal volume (103) of the case (102), wherein—in the second operative position—the seat of the container (1) is defined outside the internal volume (103) of the case (102) and is adapted to enable to insert and withdraw the product from the container (1), said container (1) being configured for switching from the first to the second operative conditions through the through opening (105) of the case (102).

In a 95th aspect according to the preceding aspect, the package further includes at least one coupling system (301) of sheet material, in particular of paper sheet material, configured to constrain the container (1) to the case (102), said coupling system (301) including:

at least one first coupling portion (307) borne by one between said case (102) and container (1), at least one second coupling portion (308) borne by the other between said container (1) and case (102), said second coupling portion (308) being engaged—at least in the first operative position of the container (1)—to the first coupling portion (307), for preventing said container (1) from switching from the first to the second operative positions.

In a 96th aspect according to the 94th or 95th aspect, the container (1) of the package referred to in the 94th or 95th aspects is according to any one of the aspects 1st to 93rd.

In a 97th aspect according to the 94th or 95th or 96th aspect, the case (102) of the package referred to in the 94th or 95th or 96th aspects is according to any one of the aspects 1st to 93rd.

In a 98th aspect according to any one of the aspects 94th to 97th, the container includes a removable tray including one or more seats for housing products.

In a 99th aspect according to any one of the aspects 94th to 98th, each seat is closed by means of a covering element made of removable or tear-off sheet material, or adapted to allow the closure of one or more products in the seat and following its removal (removal of the removable sheet)—allowing the withdrawal of at least one product.

In a 100th aspect according to any one of the aspects 94th to 99th, the seat can only be reached in the second operative position of the container.

In a 101st aspect, a method of manufacturing a package (100) according to any one of the preceding claims is provided.

In a 102nd aspect according to the preceding aspect, the method includes at least the following sub-steps:

providing the case (102) of sheet material, providing the container (1), inserting, at least partially, the container (1) into the internal volume (103) of the case (102) in order to enable to engage the first and second coupling portions (307, 308) of the coupling system (301) with each other.

In a 103rd aspect according to the preceding aspect, the step of arranging the case (102) includes at least the following steps:

arranging a first flat semi-finished product (500) of paper sheet material having:

at least a first sheet (501) including at least a first and a second portion (502, 504) interconnected by a central connecting portion (503), the first sheet (501) further including at least a first and a second lateral connecting portion (505, 506), the first portion (502) being interposed between the first lateral connecting portion (505) and the central connection portion (503), the second portion (504) being interposed between the central connecting portion (503) and the second lateral connecting portion (506), each of said portions (502, 503, 504, 505, 506) including at least one first and a second longitudinal edge opposed to each other and a first and second end edge (525, 526) opposed to each other, whereby the central connecting portion (503) and said lateral connecting portions (505, 506) being joined along the longitudinal edges and aligned along a single direction of connection to the first and second portion (502, 504) of the first sheet (501), at least a second sheet (521) connected and integrally joined to the first end edge (525) of the first and/or second portion (502, 504) of the first sheet (501), folding the second sheet (521) on the first and/or second portion (502, 504) of the first sheet (501), folding the first sheet (501) along the longitudinal edges of the portions of the same sheet to define the case (102) having at least the through opening (105), said second sheet (521) defining the first coupling portion (307) inside the case (102).

In a 104th aspect according to the preceding aspect, the second sheet (521) of the first flat semi-finished product (500) includes:

at least a first portion defining directly the first coupling portion (307) of the package, at least a second portion (522) integrally joined to the first portion and emerging from opposite lateral edges of the latter, and wherein the step of arranging the case includes the following sub-steps:

providing a predetermined amount of glue or adhesive material on the second portion (522) of the second sheet (521) or on the first portion (502) of the first sheet (501) adapted to receive said second sheet, folding the second sheet (521) on the first portion (502) of the first sheet (501) so as to firmly constrain said second portion (522) to the first sheet (501).

In a 105th aspect according to any one of the aspects 102nd to 104th, the step of arranging the container (1) includes at least the following steps:

arranging a second flat semi-finished product (50) of paper sheet material having:

at least a first sheet (51) including at least a first and a second portion (52, 54) interconnected by a central connecting portion (53), the first sheet (51) further including at least a first and a second lateral connecting portion (55, 56), the first portion (52) being interposed between the first lateral connecting portion (55) and the central connection portion (53), the second portion (54) being interposed between the central connecting portion (53) and the second lateral connecting portion (56), each of said portions (52, 53, 54, 55, 56) including at least one first and a second longitudinal edge opposed to each other and a first and second end edge (71, 72) opposed to each other, said central connecting portion (53) and said lateral connecting portions (55, 56) being joined along the longitudinal edges and aligned along a single direction of connection to the first and second portion (52, 54) of the first sheet (51), said first sheet (51) having at least one cut (85*a*) on the first portion (52), folding the first sheet (51) along the longitudinal edges of the portions of the same central sheet joining said lateral connecting portions (55, 56) to define the container (1) having at least the opening (5), the cut (85*a*) being adapted to define on the first sheet (51) the second coupling portion (308) and the thrusting element (313).

In a 106th aspect according to any one of the aspects 102nd to 105th, the cut (85*a*) defines on the first sheet (51) of the second semi-finished product (50) a tab which, following a folding step, is adapted to define the thrusting element (313) of the container (1), in particular wherein the cut (85*a*) defines the pocket (314) and the thrusting element (313) of the container (1).

In a 107th aspect according to the 105th or 106th aspect, the step of arranging the container (1) further includes at least a step of arranging at least a second sheet (57) having at least:

a first portion (58) connected and emerging from the first and/or second end edge (71, 72), a second portion (59) integrally joined to the first portion (58) of the same second sheet (57), said second portion (59) emerging from the first portion (58) so that the latter is interposed between the first sheet (51) and the second portion (59) of the second sheet (57), and wherein said method includes a step of folding the second sheet to define the closure system (7) of the container (1).

In a 108th aspect according to any one of the aspects 105th to 107th, the second flat semi-finished product (50) of paper sheet material also has:

at least a third sheet (62) including at least a portion (63) integrally joined piece to the second portion (59) of the second sheet (57), the portion (63) of the third sheet (62) emerging from the second sheet (57) opposite to the first sheet (51), said third sheet (62) being configured to define the first coupling portion (13) of the safety device (12) of the container (1), at least a fourth sheet (64) including at least a portion (65) integrally joined to the first sheet (51) and configured to define the second coupling portion (14) of the safety device (12) of the container (1), the fourth sheet (64) providing a forming step, on the respective portion (65), of at least one further portion (66) integrally joined to said portion (65) by means of a weakening line (67), said further portion (66) being configured to define the removable portion (15), optionally carrying at least one protrusion (25), the fourth sheet (64) including a portion 69 carried by the portion 65, in particular integrally joined to the portion 65, said portion 69 being configured to define a support element 16 of the control portion 28, at least a fifth sheet (60) having at least one portion (61) connected to at least one central (53) and/or lateral connecting portion of the first sheet (51) and emerging with respect to the latter from the same side from which the second sheet (57) emerges, at least a sixth sheet (80) having at least one portion (81) carried by one between the first and second portions (52, 54) of the first sheet (51), in particular connected and integrally joined to one between the first and second portion (52, 54) of the first sheet (51), configured so as to define the closure portion (209) of the occlusion system (207), the sixth sheet (80) having at least one portion (82) integrally joined to the first portion (81) of the sixth sheet (80), such that the portion (81) is included between said portion (82) of the sixth sheet (80) and one between the portions (52) and (54) of the first sheet (51).

In a 109th aspect according to the preceding aspect, the method includes at least the following steps:

folding the portion (65) of the fourth sheet (64) on the first portion (52) of the first sheet (51), said portion (65) of the fourth sheet (64) defining the second coupling portion (14) of the safety device (12), folding the portion (69) of the fourth sheet (64) on the portion (65) of the same fourth sheet (64) along a folding edge (68), folding the first sheet (51) along the longitudinal edges of the portions of the same central sheet, joining said lateral connecting portions (55, 56) to define the container (1) having at least the opening (5), folding the fifth sheet (60) according to a direction entering the container 1 to define the support portions (11), folding the first and second portions (58, 59) of the second sheet (57) to form respectively the closure portion (9) and the coupling portion (10) of the closure system (7), folding the sixth sheet (80) along the edges defining the portions (81) and (82) according to a direction directed inside the container (1), to define the closure portion (209) carried by the free edge (6) and the coupling portion (210) of the occlusion system (207);

optionally wherein, at the end of the folding steps, the removable portion (15) being at least partly contained in the internal volume (3) of the container.

In a 110th aspect according to the preceding aspect, the folding step of the fourth sheet (64) is prior to the folding step of the first sheet (51).

In a 111th aspect according to the 109th or 110th aspect, the folding step of the first sheet (51) precedes the folding step of the second sheet (57).

In a 112th aspect, use of the package (100) according to any one of the aspects 1st to 100th is provided, for the containment of products of the type including at least one of: pharmaceutical products, cosmetic products, foodstuffs.

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIGS. 1-5 are respective perspective views of a package according to the present invention;

FIGS. 16-18 are further schematic views of the package according to the present invention illustrating steps of extraction of a container from a case;

FIG. 19 is a perspective view of a package according to the present invention having a container placed in a second operative position or at least partly disposed outside a case;

DETAILED DESCRIPTION

Figure 3:
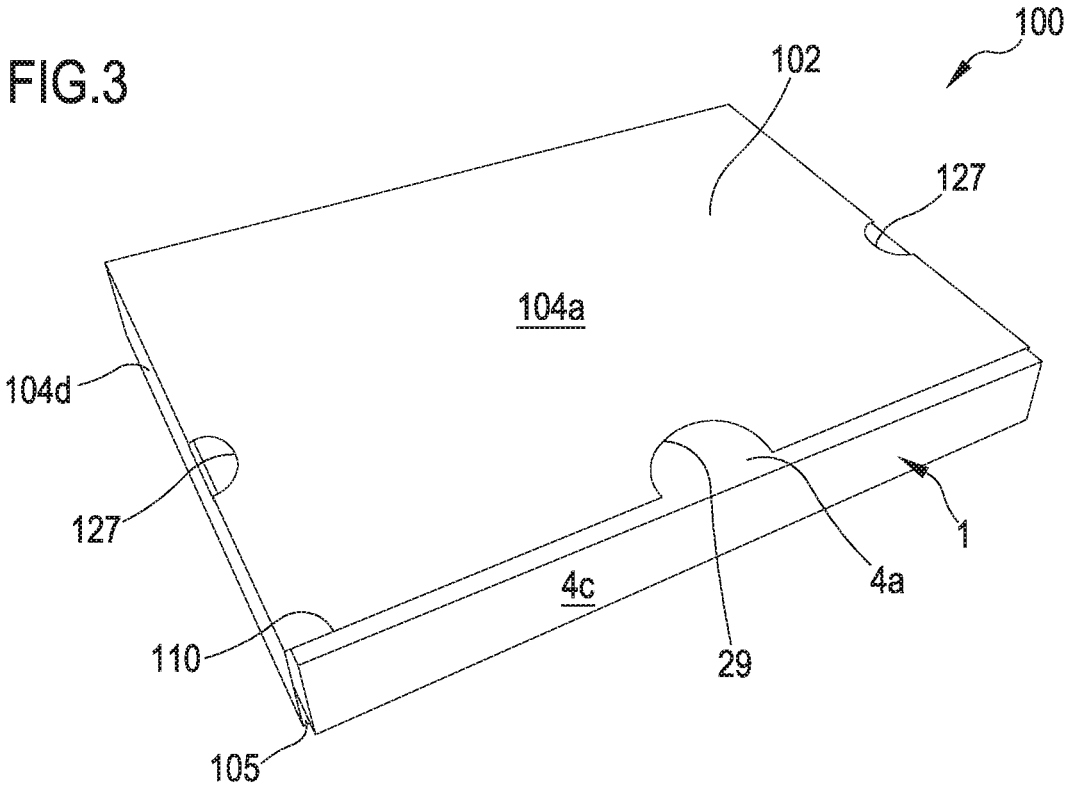
Figure 4:
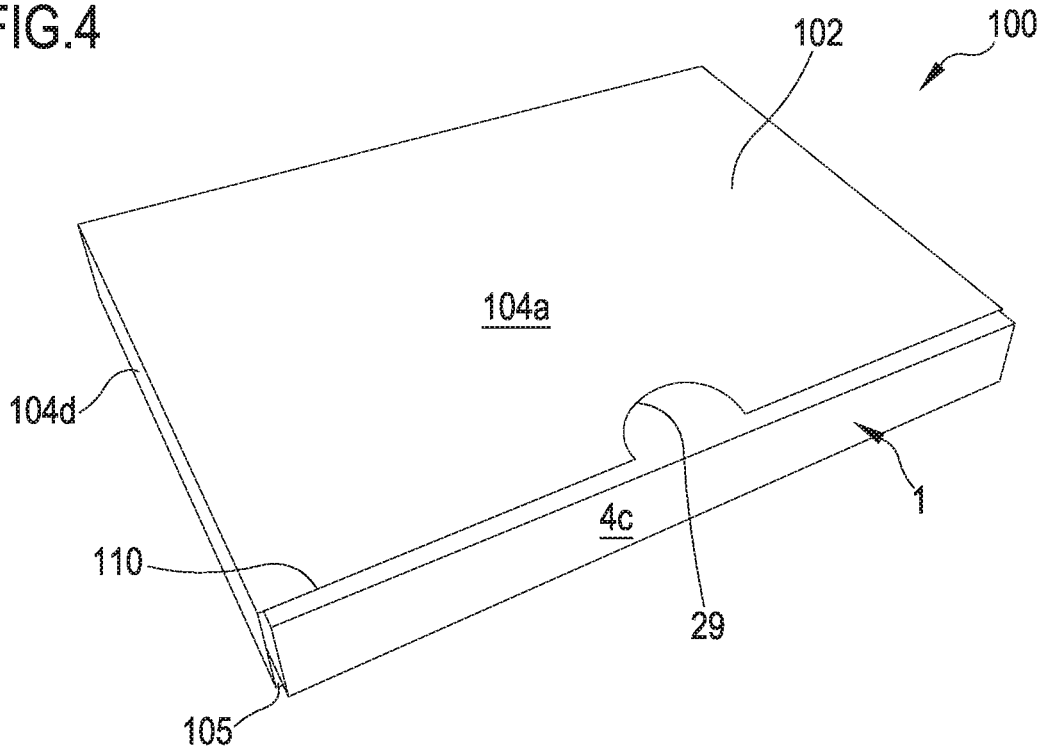

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations. By the term product it is instead meant an article or a mixture of articles of any kind. For example, the product may be a drug or medicine in solid or liquid form or in the form of gel, or in the form of two or more of the above aggregation states. The product may also for example include: food products (such as confectionery products), cigarettes or cigars. The term product can also be understood to be a package, such as a blister, carrying a plurality of articles. The term product may also denote at least one selected from the group including: one or more bottles of articles for cosmetics, one or more bottles of medicines.

The term paper material means paper or cardboard; in particular, the sheet material which can be used for making the package can have a weight of between 100 and 500 g/m$^2$, in particular between 200 and 400 g/m$^2$. The subject paper material extends between a first and a second prevailing development surface. The paper material in sheet used for making the package may, in one embodiment variant, be covered by at least a part of the first and/or second prevailing development surface by means of a plastic coating, such as a film, whose purpose is to reinforce the package. If the coating is arranged so as to cover an external surface of the package, this can also be used to define a barrier to water and/or humidity useful to prevent the weakening and loss of structurality of the package with consequent deformation of the paper material making up the latter. Advantageously but without limitation, the coating may include a plastic film adapted to completely cover both sides (first and second prevailing development surface) of the paper material defining the package; the thickness of the coating film may have variable values between 5 and 300 μm, in particular between 10 and 200 μm, even more particularly between 10 and 100 μm. The plastic coating may be selected, for example, from the following materials: LDPE, HDPE, PP, PE.

Package 100

Reference numeral 100 denotes a package, for example usable for containing products, which can be applied in all the sectors requiring, for reasons of safety, preventing the opening of the same package by children; advantageously but without limitation, the package 100 can also find application in all the sectors which provide for the closure of the package itself and provide a security that allows evidencing a possible tampering of the latter.

The package 100 includes a case 102 (e.g., a housing) adapted to receive a container 1 at its interior; the container, as will be better described below, is adapted to contain one or more products (for example drugs, foods, products for cosmetics) and is configurable at least between:

- a first operative position in which the same container 1 is housed in the case 102. In the first operative position of the container, the case prevents the insertion or withdrawal of products from the container;
- a second operative position in which the same container 1 is at least partly disposed outside the internal volume 103 of the case 102, allowing the insertion or withdrawal of product from the container 1.

Figure 5:
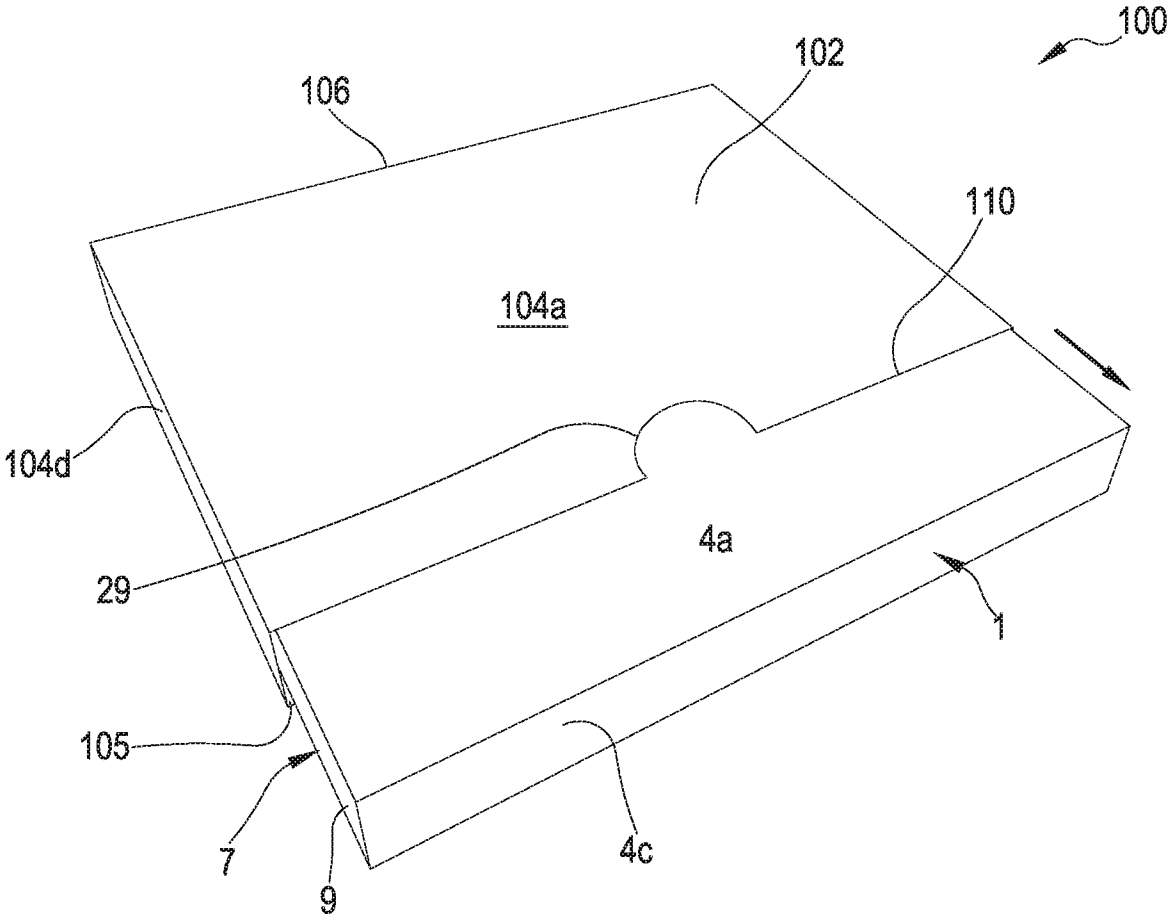
Figure 6:
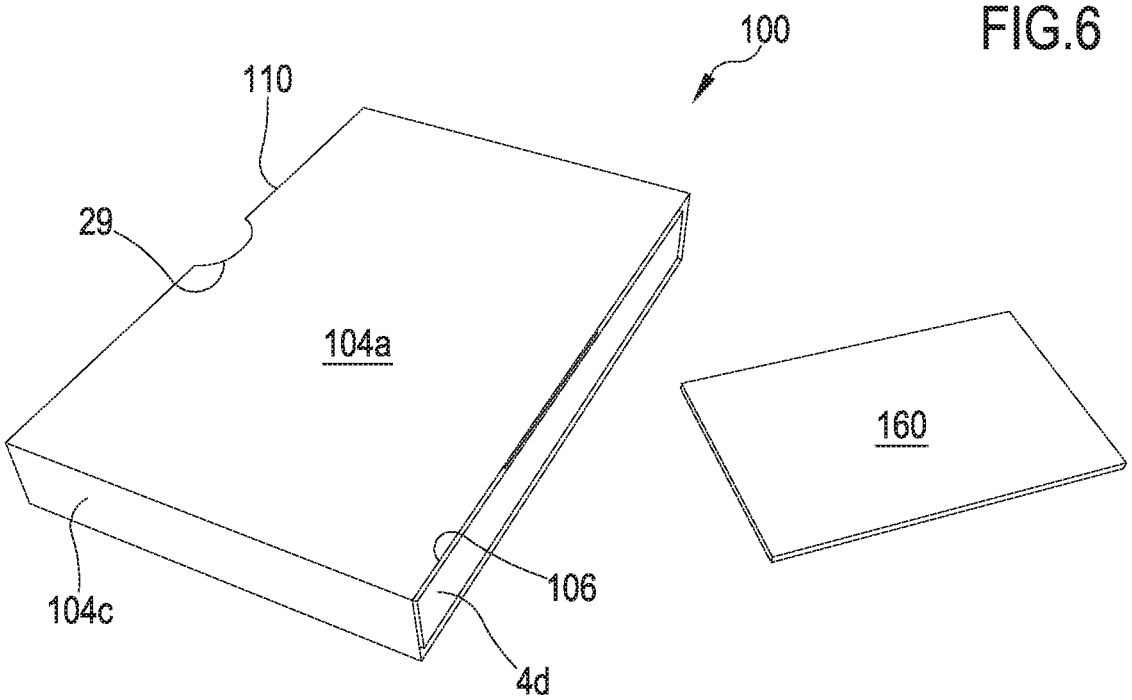
FIG. 6 is a further perspective view of a package according to the present invention and an opening device which can, without limitation, be included in the same package.
Figure 7:
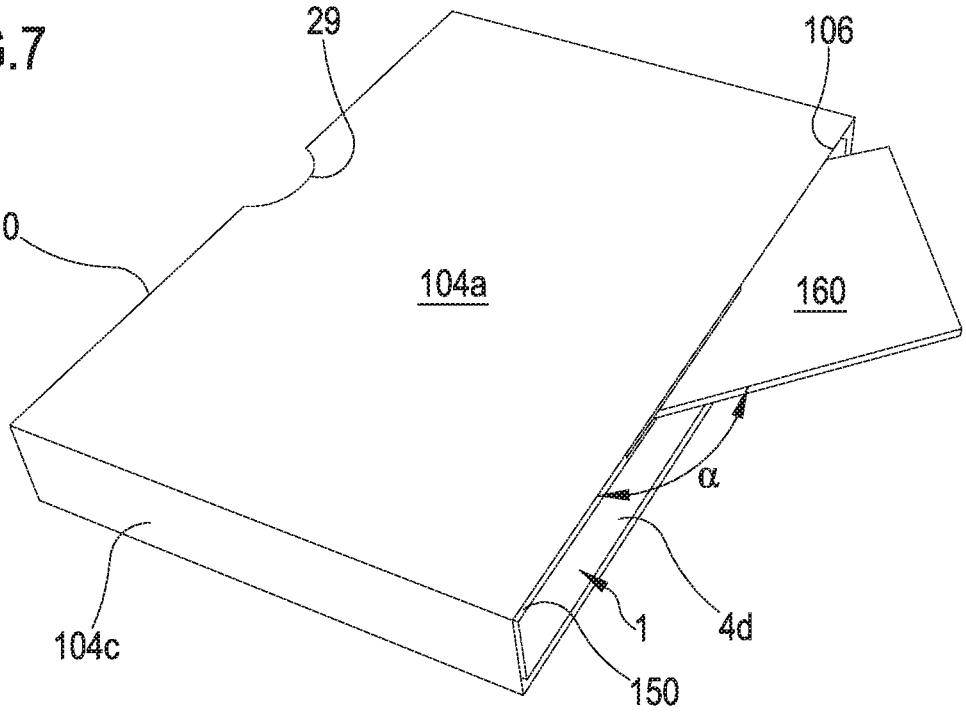
FIG. 7 is a perspective view of a package according to the present invention in cooperation with an opening device.

As can be seen from the accompanying figures, the case 102 is made of sheet material, in particular of paper sheet material, defining an internal volume 103. In particular, the case 102 includes a predetermined number of lateral walls 104 defining at least one through opening 105 delimited by a free edge 110: the through opening 105 is configured to connect the internal volume 103 with the external environment, as well as to allow the insertion and removal of the container 1 from said internal volume 103 (see, for example, FIG. 5).

The accompanying figures show, without limitation, a configuration of the case having two through openings opposite each other 105 and 105*a*, so that the case 102 can substantially define a conduit or tube delimited by the lateral walls 104 and open at the two ends, in particular longitudinal ends.

In further detail, the case 102 includes a front lateral wall 104*a* and a rear wall 104*b* connected through two lateral walls 104*c* and 104*d*; the ends of the front, rear and lateral walls 104*a*, 104*b*, 104*c*, 104*d* therefore define:

- a first through opening 105 delimited by a free edge 110 and placed at a first longitudinal end portion of the case, the through opening 105 is configured to allow the movement of the container 1, located at least partially inside the volume 103 of the case 102, in insertion and extraction through the case,
- a second opening 105*a* delimited by a respective free edge 106 and placed at a second end portion of the case opposite the first end portion. The presence of this second opening 105*a* is not binding for the correct operation of the package 100 and can be partly occluded by a wall or closure system (condition not shown in the accompanying figures).

The accompanying figures show a preferential but non-limiting configuration of the case 102, which has a rectangular prismatic shape (flat lateral walls 104 having a rectangular shape). The case 102 has in fact a front wall 104*a* and a rear wall 104*b* facing and parallel to each other: the front wall and the rear wall are connected to each other by means of a first and a second lateral wall 104*c*, 104*d* also facing each other and parallel to each other. The front wall 104*a* is spaced from the rear wall 104*b*; the first and second lateral walls 104*c*, 104*d* are also spaced from each other. The case 102 includes of walls with a square or rectangular shape, combined to form a four-sided rectangular parallelepiped defining the internal volume 103. However, the possibility of making a case 102 having a different shape, for example a trapezoidal section, is not excluded.

Figure 10:
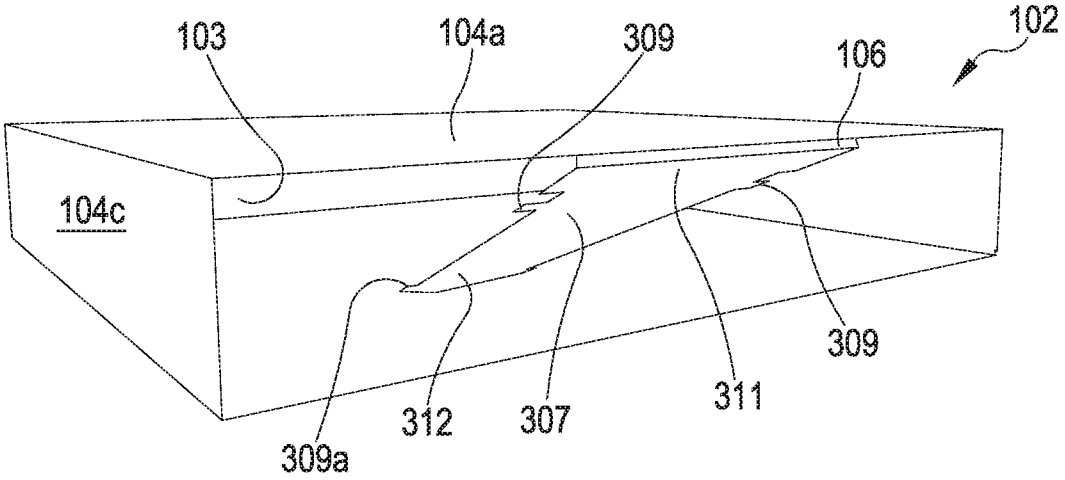
FIGS. 10 and 11 are perspective views of a case of the package according to the present invention.
Figure 11:
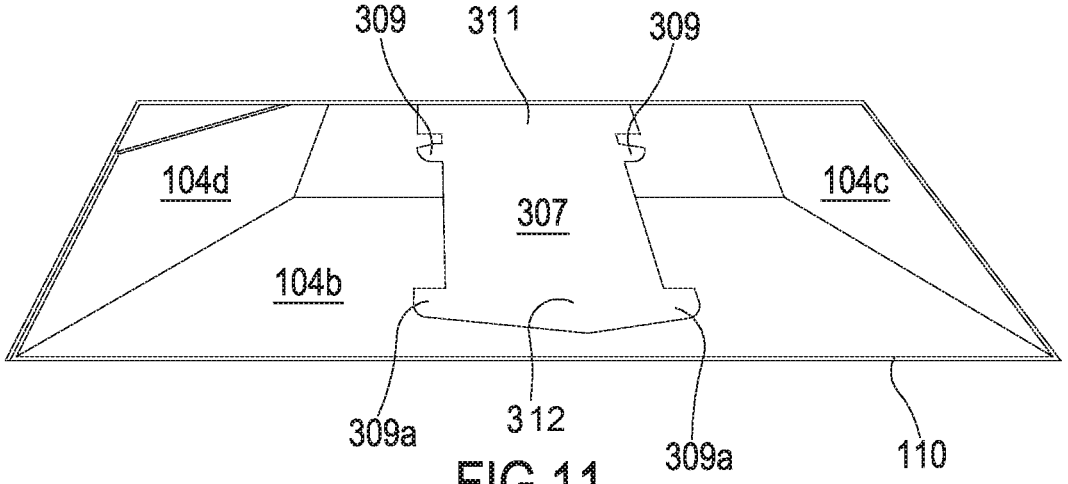

The case 102 includes, at the free edge 106, a first coupling portion 307 emerging from at least one wall 104, defining a protrusion folded internally to the internal volume 103 (see, for example, FIGS. 10 and 11). In this embodiment, the first coupling portion 307 is directly constrained, in particular integrally joined, to the free edge 106 defined by the end of the front wall 104*a*: the first coupling portion 307 emerges starting from the free edge 106 according to a direction entering the internal volume 103 or in the direction of the through opening 105 of the case 102. In greater detail, the first coupling portion 307 is constrained to the front wall 104*a* of the case 102 (FIGS. 10 and 11). The first coupling portion 307 is movable relative to the walls 104 by rotation about the free edge 106 to which it is constrained. In particular, the first coupling portion 307 is joined to the upper wall 104*a* and is movable by rotation relative to the latter.

As will be better described hereinafter, the first coupling portion 307 is configured to stably engage to at least a second coupling portion of the container 1; the engagement between said first and second coupling portion 307, 308 being adapted to define the stable constraint between case and container placed at least partly inside said case. The second coupling portion 308 is engaged—at least in the first operative position of the container 1—to the first coupling portion 307, for preventing said container 1 from switching from the first to the second operative positions.

In greater detail and as visible, for example, in FIGS. 10 and 11, the first coupling portion 307 develops, in particular predominantly, along a predetermined extension direction D; the first coupling portion 307 includes at least one lateral stop element 309 adapted to define, in the first operative position of the container 1, an undercut with the second coupling portion 308 of the container 1. The accompanying figures show a preferential but non-limiting embodiment of the invention in which the first coupling portion 307 of the case 102 includes two lateral stop elements 309 opposed to each other, in particular emerging from the side edges opposed to each other of the first coupling portion 307 itself. The two lateral stop elements 309, according to the preferred embodiment shown in the accompanying figures, are symmetrical with respect to the extension direction D of the first coupling portion 307, both defining an undercut with the corresponding second coupling portion 308 of the container 1. The lateral stop element 309, made of paper sheet material, essentially defines a lateral protuberance with respect to the first coupling portion 307 emerging therefrom in a transverse direction, particularly orthogonal, with respect to the predetermined extension direction D of the first coupling portion 307. In the preferred embodiment, the lateral stop element 309 is integral with the first coupling portion 307. The lateral stop element 309 defines an undercut with the second coupling portion 308 of the container 1 ensuring the stable constraint between the container 1 and the case 102 during the first operative position. In the accompanying figures, an embodiment of the stop element 309 having a substantially quarter-circle shape has been illustrated; obviously, the possibility of making a stop element having a polygonal shape, for example triangular, rectangular, square, is not excluded.

If two stop elements 309 are present, the latter may advantageously have the same shape (condition illustrated in the accompanying figures) or may have a different shape from each other.

As visible, for example, in FIG. 11, the first coupling portion 307 can include, without limitation, at least one auxiliary lateral stop element 309*a* spaced, according to the extension direction D, from the stop element 309. This auxiliary lateral stop element 309*a* is adapted to define an auxiliary undercut that can be stably engaged, in the second operative position of the container 1, to the second coupling portion 308 of the container 1, in order to prevent—as will be better described below—the total extraction of the container 1 from the case 102. The first coupling portion 307 includes two auxiliary lateral stop elements 309*a* which are mutually opposite and emerging from opposite lateral edges of the first coupling portion 307. In particular, these two auxiliary lateral stop elements 309*a* emerge from the first coupling portion 307 according to a transverse direction, in particular orthogonal, to the predetermined extension direction D of the first coupling portion 307. Each of the aforesaid auxiliary lateral stop elements 309*a* defines a respective auxiliary undercut which is stably engaged, in the second operative position of the container 1, to the second coupling portion 308. In the preferred embodiment, each auxiliary lateral stop element 309*a* is integral with the first coupling portion 307.

In particular, each lateral stop element 309 and each auxiliary lateral stop element 309*a* are integral with the first coupling portion 307, which is in turn connected to the front wall 104*a* of the case 102 along the free edge 106 and folded within the volume 103 of the case 102. In particular and according to a preferential but non-limiting embodiment of the invention, the first coupling portion 307, the lateral stop element 309 and the auxiliary lateral stop element 309*a* are made of sheet material, in particular of paper sheet material. The auxiliary stop element 309*a* shown in the accompanying figures has a substantially square or trapezoidal shape, connected at an angle; obviously, the possibility of making an auxiliary stop element having a different shape, for example triangular or rectangular, is not excluded.

Figure 12:
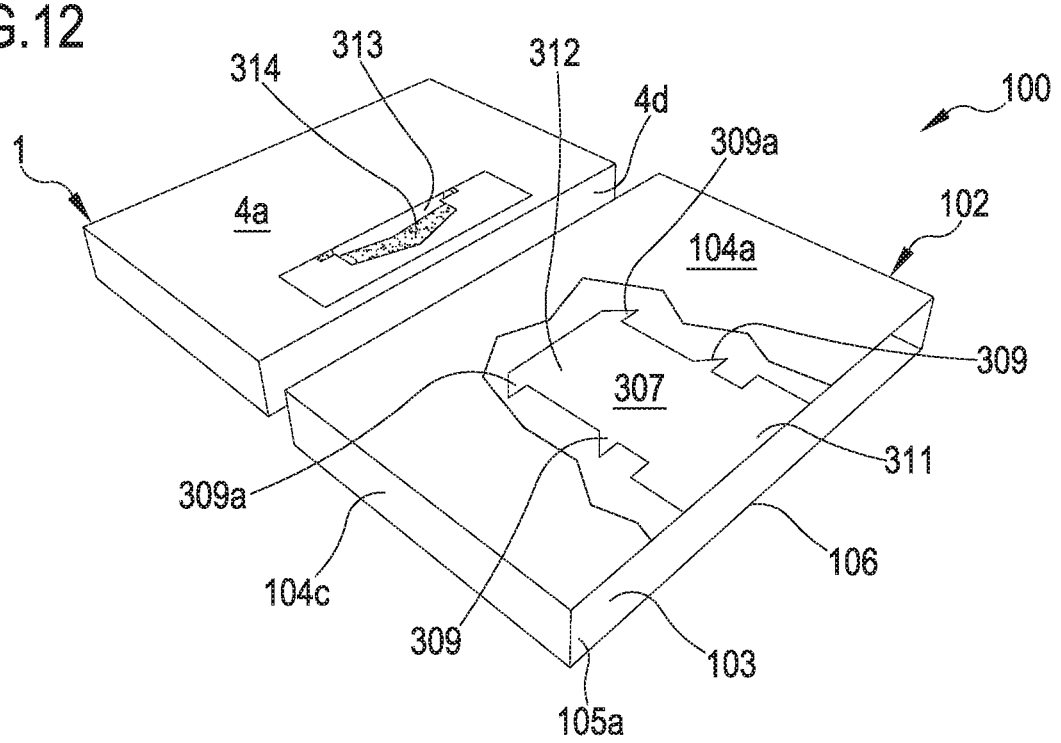
FIG. 12 is a schematic view of a case and a container of the package according to the present invention placed next to each other.
Figure 13:
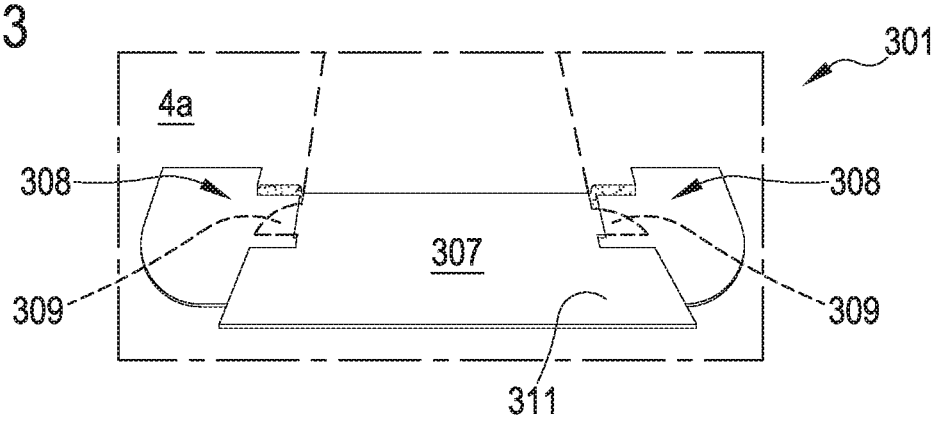
FIGS. 13-15 are schematic views of the package according to the present invention in which a container is placed in a first operative position in which it engages a case.
Figure 14:
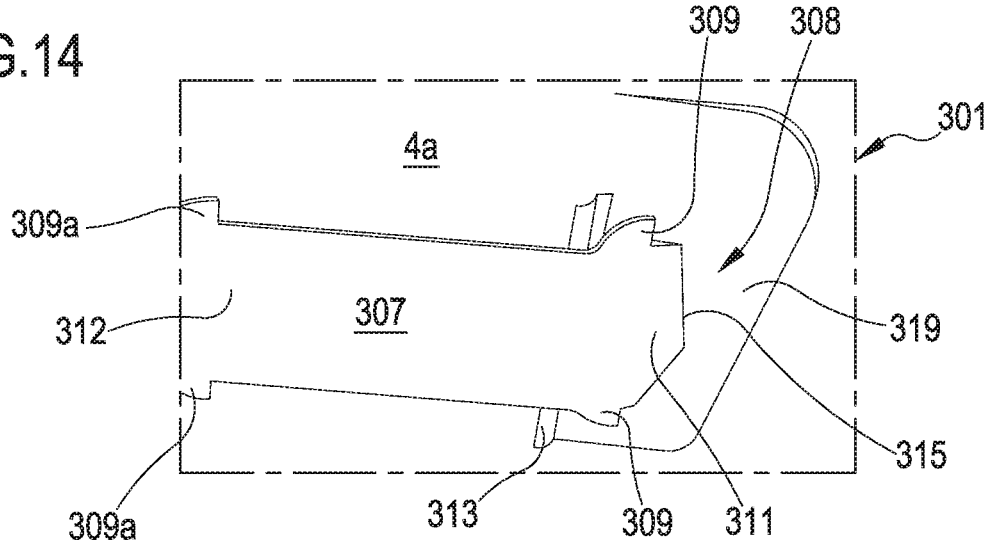
Figure 15:
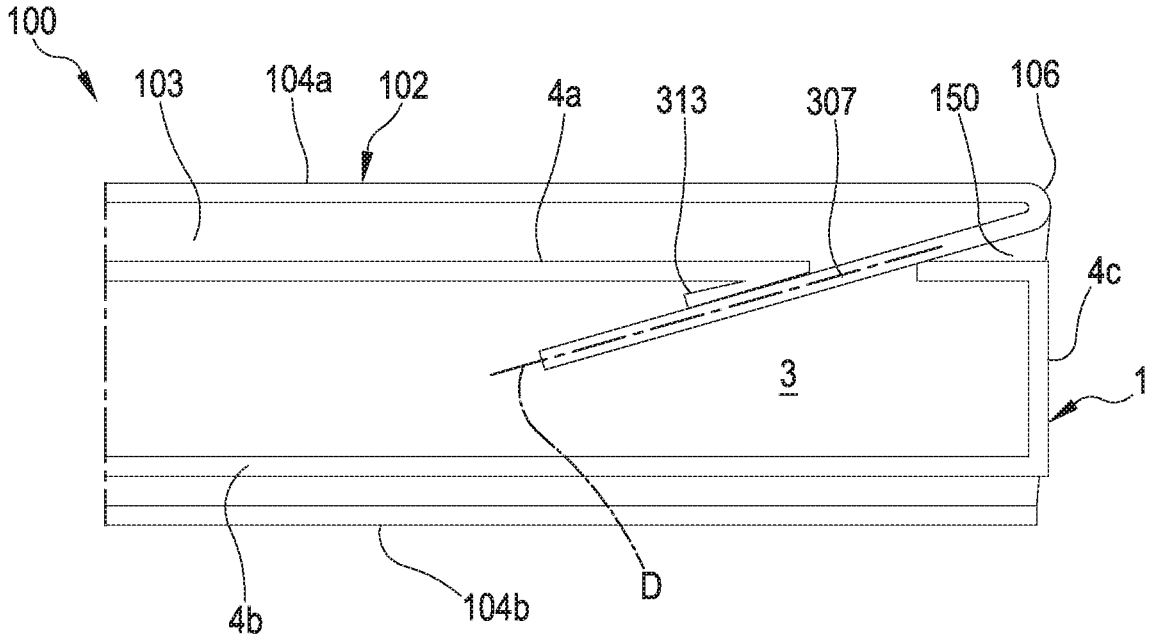
Figure 16:
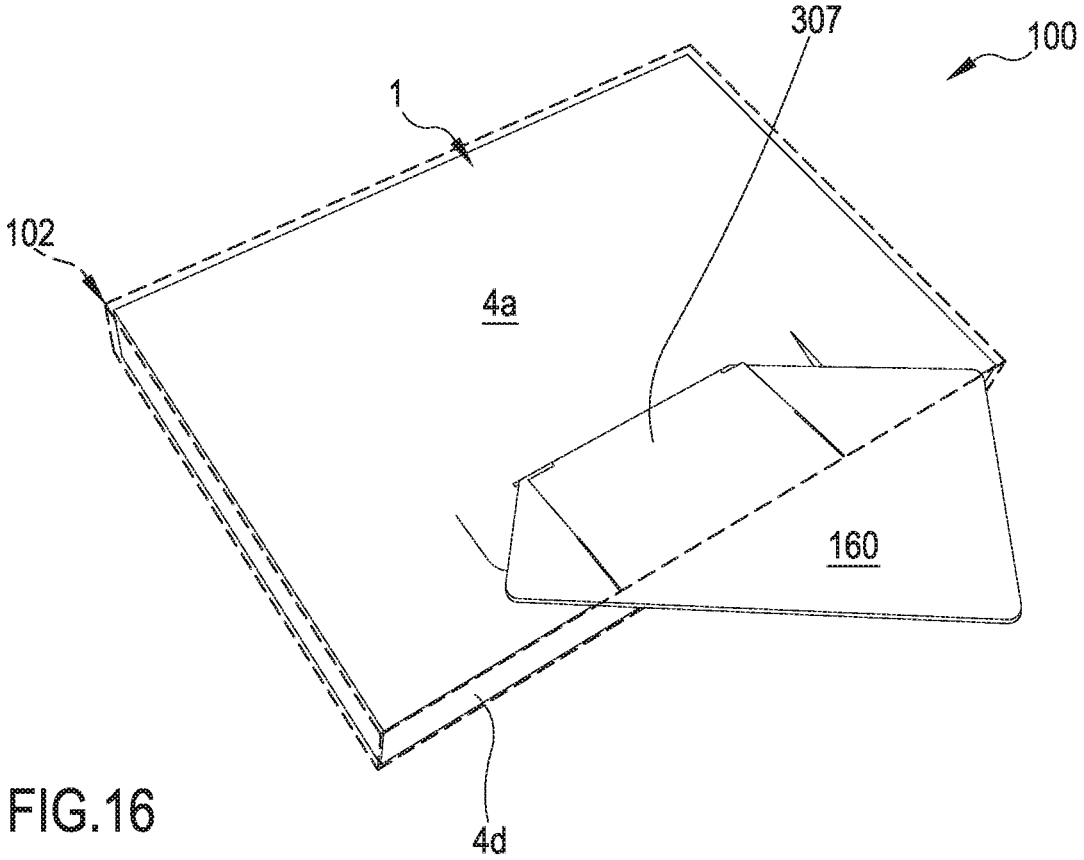

The lateral stop element 309, the auxiliary lateral stop element 309*a* can be defined respectively along a base portion 311 and a head portion 312 of the engagement portion 307 of the case (see for example FIGS. 10-12). The base portion 311 is integrally joined to the edge 106 of the case 102 while the head portion 312 defines the end section of the first coupling portion 307, in particular between 40 mm and 600 mm away from the free edge 106 of the case 102, more precisely between 50 mm and 200 mm away from the free edge 106 of the case 102. The distance present between the base portion 311 and the head portion 312 essentially defines the length, measured along the extension direction D, of the first coupling portion 307, optionally also defines the distance between the lateral stop elements 309 and the auxiliary lateral stop elements 309*a*. The distance between the lateral stop elements 309 and the auxiliary lateral stop elements 309*a* ensures the possibility of moving the container 1 between the first and second operative positions. However, the possibility of increasing or decreasing the dimensional values mentioned above in order to be able to produce packages 100 with different dimensions is not excluded.

It should also be noted that in the accompanying figures, a configuration of the coupling portion 307 having only a pair of stop elements 309 and a single pair of auxiliary stop elements 309*a* has been illustrated; the possibility of making a coupling portion 307 having a plurality of auxiliary stop elements 309*a* disposed along the extension of the portion 307 and spaced from one another, which are configured to define one or more intermediate operative positions of the container defined between first and second operative position, is not excluded.

The case 102, as described above, has two openings 105 and 105*a* defined by the ends of the lateral walls 104: in a further embodiment it is possible that the opening 105*a* is partially occluded by an additional wall, including a tab, in particular of paper sheet material, carried by at least one lateral wall 104 of the case 102. Said tab is optionally joined, in particular integrally joined, to a lateral wall 104 and is adapted to promote an additional level of safety in protecting the container 1 inside the volume 103 of the case, in particular during the first operative position of the container 1 itself, in order to avoid any tampering. Advantageously, the tab of the additional wall has an opening configured to allow insertion and extraction of an opening device 160 through the case 102; the structure and the operation of said opening device 160 will be better detailed below.

As can be seen, for example, in FIG. 3, the case 102 may include, advantageously but without limitation, at least one recess 127 defined on at least one lateral wall 104, in particular this opening 127 is present, according to a preferential embodiment, at an end of the front wall 104*a*, specifically near a connecting edge with the lateral wall 104*c* and/or 104*d*. The recess 127 is configured to allow the display, from the outside of the case 102, of a part of the container 1.

As shown in the accompanying figures, there are two through recesses 127 defined on the front wall 104*a* of the case 102, in particular close to the lateral walls 104*c*, 104*d* and having a shape selected from circular, rectangular, square, triangular, trapezoidal, semicircular.

As can be seen in FIGS. 1-7, the case 102 may further include, by way of non-limiting example, at least one through recess 29 defined at least on a lateral wall 104 of the case 102; in particular, the case has a through recess 29 defined on the front lateral wall 104*a* of the case 102 and a through recess 29 defined on the rear lateral wall 104*b*; the recesses 29 are essentially facing and opposing each other and essentially define a lowering of the free edge 110. Each recess 29 is configured to allow—at least during the first operative position of the container 1—the exposure of at least part of the container 1 in such a way as to facilitate the gripping and extraction of the container 1 from the case. The recess 29 has a shape selected from circular, rectangular, square, triangular, trapezoidal, semicircular.

From a dimensional point of view, the case 102 defines an internal volume 103 substantially greater than 100 $cm^3$, in particular between 150 $cm^3$ and 400 $cm^3$. The case 102, object of the present invention, can be used to house containers or products of medium size; in this condition, the case 102 may have an internal volume of more than 500 $cm^3$, in particular between 800 and 1,400 $cm^3$. However, the possibility of using package 100 for packaging large products is not excluded; in this condition, the case 102 may have an internal volume 103 greater than the volumes specified above, for example greater than 10,000 $cm^3$ and in any case in a non-limiting manner.

As briefly described above and as can be seen in the accompanying figures, the package 100 includes a container 1 made of sheet material, in particular of paper sheet material, defining an internal volume 3 and configured for housing at least one product. The container 1 has a predetermined number of lateral walls 4 defining at least one opening 5 delimited by a respective free edge 6: the opening 5 is configured to allow insertion and withdrawal of the product from the container. Container 1 is at least configurable between:

- a first operative position, wherein the container itself 1 is at least partially housed into the case 102, wherein—in the first operative position—the opening 5 is at least partially defined inside the internal volume 103 of the case 102, which—in such first operative position—prevents the product from being inserted and withdrawn through said opening 5 of the container 1,
- a second operative position wherein the container 1 itself is at least partially disposed outside the internal volume 103 of the case 102, wherein—in the second operative position—the opening 5 of the container 1 is defined outside the internal volume 103 of the case 102 and is adapted to enable to insert and withdraw the product from the container 1, said container 1 being configured for switching from the first to the second operative conditions through the through opening 105 of the case 102.

The container 1, made of sheet material, in particular of paper sheet material, and defining an internal volume 3, has a rectangular prismatic shape (flat lateral walls 4 having a rectangular shape), although not excluding the possibility of making a container 1 having a different shape, for example square, trapezoidal or cylindrical. In particular, the container 1 has a front lateral wall 4*a* and a rear lateral wall 4*b* facing and parallel to each other: the front wall 4*a* and the rear wall 4*b* are connected to each other by lateral walls 4*c*, 4*d*, also facing each other and parallel to each other. The front wall 4*a* is spaced from the rear wall 4*b*; the lateral walls 4*c*, 4*d* are also spaced from each other (FIGS. 8, 12, 16, 23). The ends of the front, rear and lateral walls (4*a*, 4*b*, 4*c*, 4*d*) define the opening 5, delimited by the free edge 6 which includes at least one closure system 7 (FIG. 19-23) which has the purpose of regulating access to volume 3 inside the container 1. In the accompanying figures, a configuration of the container 1 having two openings 5 opposite each other is illustrated, without limitation. However, the possibility of making, for example, a container 1 having a single opening 5 is not excluded. At each opening 5, the container has a respective closure system 7. Advantageously, the container 1 is at least partly counter-shaped to the case 102 so as to allow its insertion into the volume 103 of the case 102 and ensure adequate stability.

From a dimensional point of view, the container 1 may define an internal volume 3 substantially greater than 40 $cm^3$, in particular between 100 and 400 $cm^3$. However, the container 1 object of the present invention can be used for packaging medium-sized products; in this condition, the container may have an internal volume 3 greater than 500 $cm^3$, in particular between 800 and 1,400 $cm^3$. However, the possibility of using the container 1 of the present invention for packaging large products is not excluded; in this condition, the container has an internal volume 3 greater than the volumes specified above, for example greater than 10,000 $cm^3$.

Figure 23:
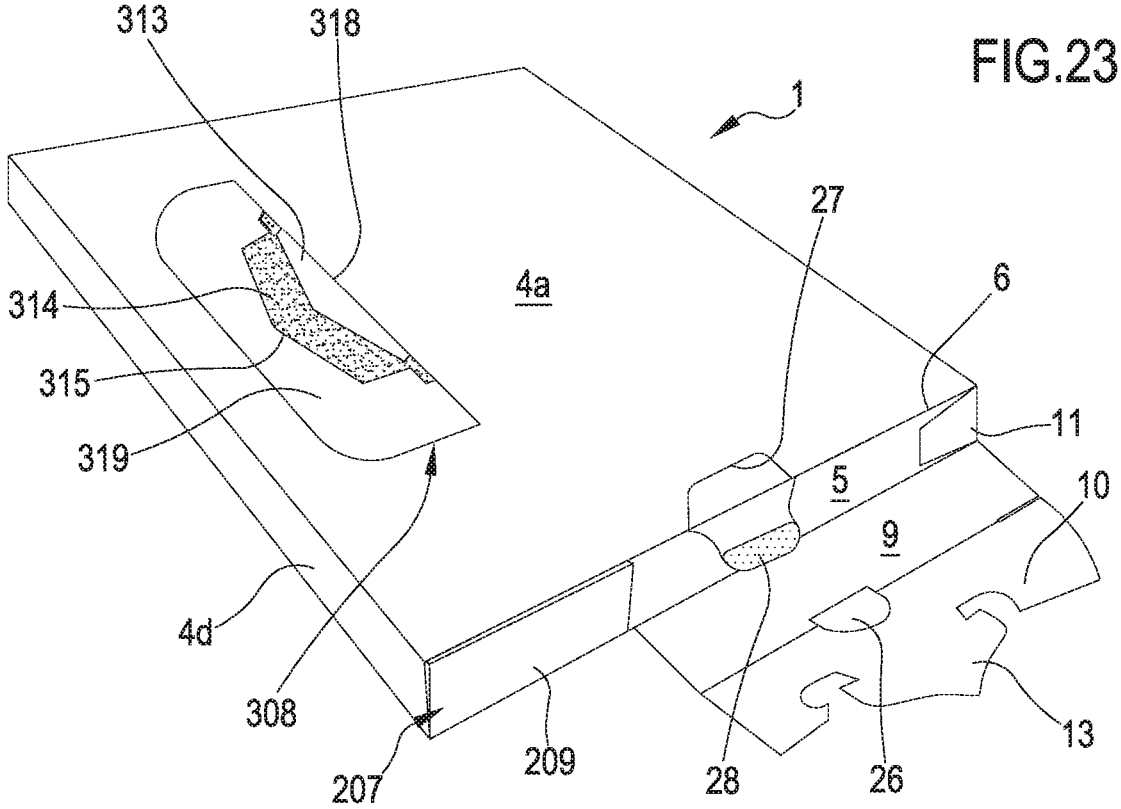
FIGS. 23 and 24 are perspective views of a container of a package according to the present invention following a first opening condition.

As can be seen, for example, in FIG. 23, the container 1 can include, at the free edge 6 and in proximity to the through opening 5, a hole 27; as can be seen in the accompanying figures, the recess 27 is in contact with the free edge 6 to define a sort of lowering on the latter. Advantageously, the recess 27 is defined on the upper 4*a* or lower 4*b* wall adapted to abut directly on the closure system 7 of the container 1 which will be better described below. The recess 27 has an open peripheral profile which has a substantially "C" or "V" shape or a "U" shape, the concavity whereof faces opposite to the internal volume.

In detail, the closure system 7, also made of sheet material, is engaged at the free edge 6 and movable, in particular by rotation, relative to the lateral walls 4. The closure system 7 is advantageously but not limitingly integrally joined to the lower wall 4*b*, in particular to the free edge 6, and is movable by rotation around the latter between at least the closed and open conditions. The closure system 7 is configured to define at least one closed condition in which the system 7 itself prevents communication between the internal volume 3 and the external environment; the closure system 7 is further configured to define at least one open condition in which the system 7 itself allows communication between the internal volume 3 and the external environment. In fact, the system 7 substantially represents a cover adapted to manage access to the internal volume 3. Advantageously, the container 1 includes a closure system 7 for each through opening 5, as illustrated for example in FIGS. 19, 21.

In the accompanying figures, a configuration of the container 1 having an opening 5 is shown without limitation; in this condition, the container 1 has a closure system 7 engaged to the free edge 6.

Figure 20:
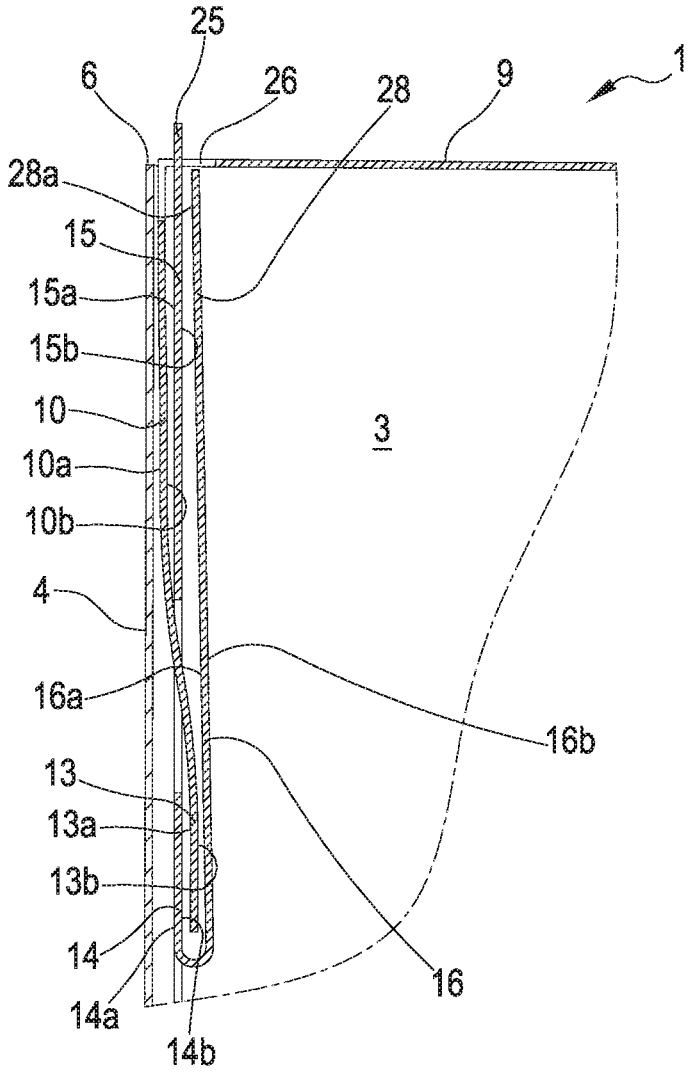
FIG. 20 is a sectional view of an embodiment of a container of the package according to the present invention.
Figure 21:
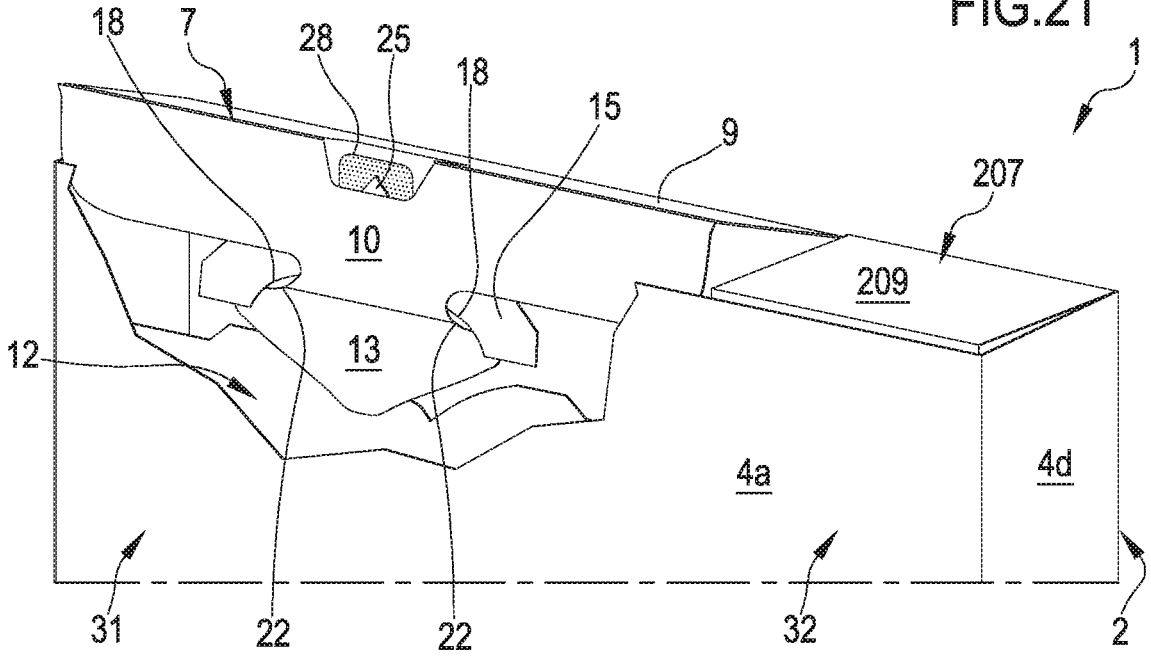
FIGS. 21 and 22 are schematic views of a first opening step of the container of the package according to the present invention.

In greater detail, the closure system 7 includes at least one tab 8 which has a closure portion 9 directly engaged and integrally joined to the free edge 6 (in particular to the portion of the free edge of the lower wall 4*b*): the closure portion 9 represents the component of the tab 8 configured to prevent the passage through the opening 5 in the closed condition of the closure system 7 itself. As can be seen in the accompanying figures, the closure portion 9 substantially includes a flat body made of sheet material, at least partially counter-shaped to the free edge 6 of the opening 5. In the accompanying figures, a preferential configuration of the closure portion 9 having a rectangular shape is schematized. The tab 8 further has at least a coupling portion 10 configured to fit, in the closed condition of the closure system 7, inside the volume 3. The coupling portion 10 is integrally joined to the closure portion 9: the coupling portion 10 substantially represents an extension of the closure portion 9 adapted to fit, in the closed condition of the system 7, into the internal volume 3 of the container 1. As can be seen in FIGS. 20 and 21, the coupling portion 10 extends between a first and a second prevailing development surface 10*a*, 10*b* respectively facing outwards (directly facing a lateral wall 4 of the container 1) and towards the internal volume 3. In the closed condition of the system 7, at least a portion of the first development surface 10*a* of the coupling portion 10 faces, in particular contacts, directly a part of a lateral wall 4 (in particular the front wall 4*a*): the surface 10*a* at least partly extends parallel to the front wall 4*a* opposed to the wall directly connected with the closure portion 9.

The closure portion 9 and the coupling portion 10 have a mutual connection edge parallel and opposite to the free edge 6 with respect to the closure portion 9 itself: the coupling portion 10 is movable by rotation with respect to the closure portion 9 around to this mutual connection edge. The coupling portion 10, in the closed condition of the system 7, is configured to define, according to a cross section and in cooperation with the closure portion 9, a substantially "L" shape: in this condition, the coupling portion 10 extends substantially parallel to a front or rear wall 4*a*, 4*b*.

As can be seen, for example, in FIG. 23, the closure system 7 further includes at least one abutment portion 11 engaged to the free edge 6 of one of the lateral walls 4*c*, 4*d* adjacent the tab 8: the abutment portion 11, in the closed condition, is configured to be interposed between the internal volume 3 and the tab 8 in such a way as to cooperate with the latter in order to keep it stable in said closed condition. The abutment portion 11 essentially includes a flat tab of sheet material integrally joined to the free edge 6 of one of the lateral walls 4*c*, 4*d* adjacent to the closure portion 9. The abutment portion 11 has, without limitation, a rectangular or trapezoidal shape. The abutment portion 11 is also configured to rotate around the free edge 6 to face, at least in the closed condition of the container 1, towards the internal volume 3. In greater detail, the abutment portion 11 is connected to the free edge 6 so as to engage, in the closed condition of the container 1, at least part of the coupling portion 10 and/or of the closure portion 9 to stably maintain tab 8 in said condition.

As described above, the container includes a recess 27; the recess 27 is arranged, without limitation, on the upper wall 4*a* configured to directly face the coupling portion 10, in particular the first surface 10*a* of said portion 10.

Figure 25:
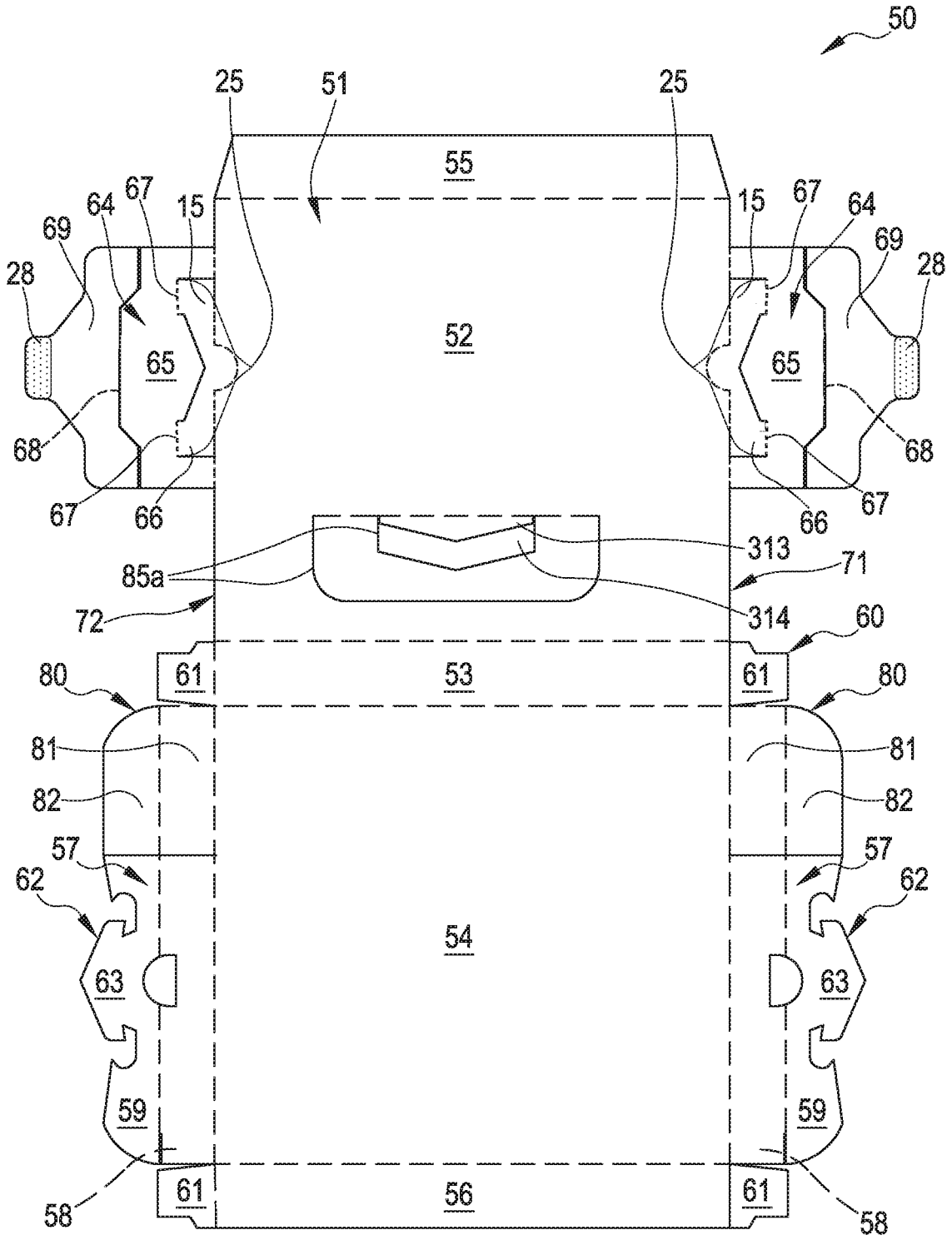
FIG. 25 is a top view of a flat semi-finished product for making a container of the package according to the present invention.

As can be seen in the accompanying figures, the closure system 7 may include, without limitation, a through opening 26 on the tab 8, configured to arrange, in the closed condition of the system, at the free edge 6, in particular at the recess 27. In fact, the through opening 26, in the closed condition of the closure system 7, is arranged at the recess 27 (FIG. 25): in particular, in this condition, opening 26 and recess 27 are facing and at least partially counter-shaped to one another.

As can be seen in the accompanying figures, the through opening 26 defines a closed peripheral profile, in particular having at least one of the following shapes selected from the group: rectangular, square, circular, elliptical, semicircular, triangular. The through opening 26 is defined on the closure portion 9 and/or on the coupling portion 10 of the tab 8. In a preferential but non-limiting embodiment of the invention, the through opening 26 is defined, without interruption, at least partly on the closure portion 9 and at least partly on the coupling portion 10 of the tab 8: the opening 26 is substantially defined on the folding line of the portions 9 and 10 of the tab 8 (FIG. 23).

Figure 22:
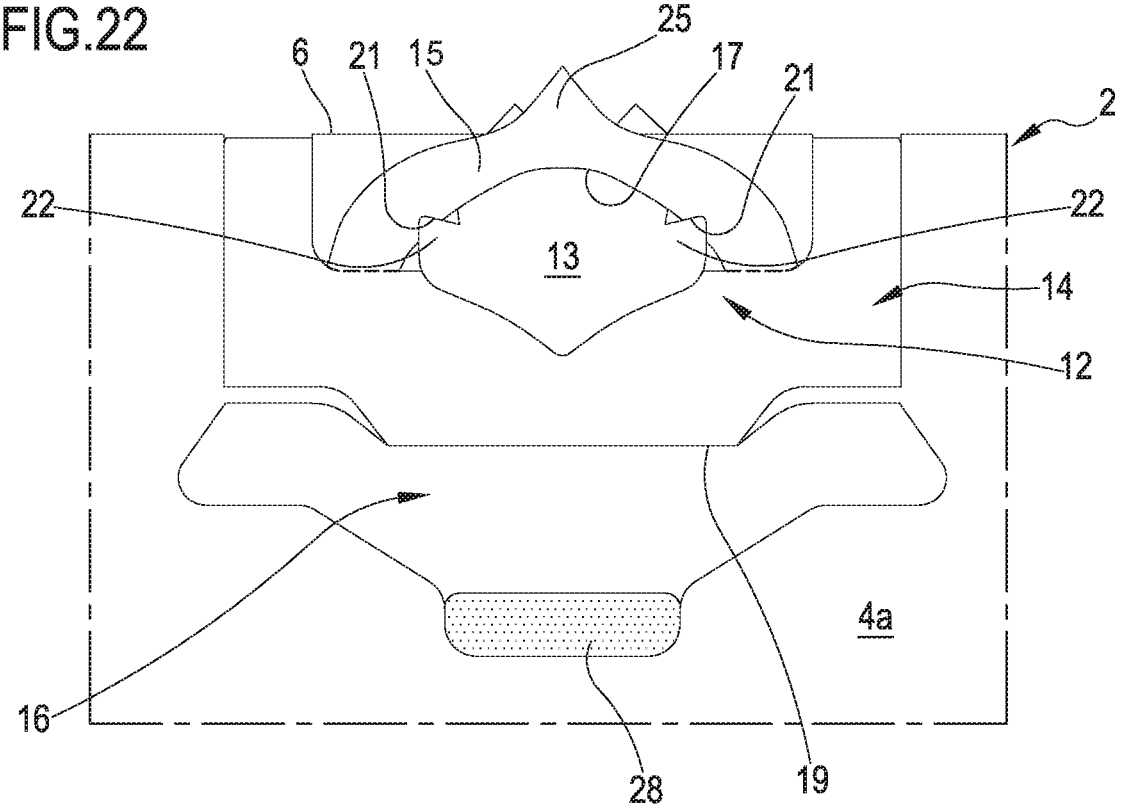

In the accompanying figures, a preferential but non-limiting embodiment of the invention is illustrated in which the container 1 further includes at least one safety device 12, made of paper sheet material, which has at least a first coupling portion 13 carried by the tab 8 and at least a second coupling portion 14 engaged to the front wall 4*a* (FIGS. 21 and 22). The first and second coupling portion 13, 14 of the safety system 12 are configured to stably engage with each other during a first closed condition of the closure system 7, or during a first complete closure of the system 7 in which the first insertion of the coupling portion 10, in particular of the first coupling portion 13, into the internal volume 3. As can be seen in the accompanying figures, the second coupling portion 14 of the safety system 12 is arranged in the internal volume 3 and lies substantially in a plane parallel to the front wall 4*a*: in the closed condition of the system 7, the first coupling portion 13 is configured to fit at least partially into the internal volume 3 to stably engage the second coupling portion 14. The first and/or the second coupling portion 13, 14 of the safety system 12 include at least one removable portion 15, configured to separate from the safety device 12 following a first opening of the closure system 7, following said first closed condition, to show evidence of tampering with the container 1.

The accompanying figures show, by way of non-limiting example, a configuration of the container 1 in which the first coupling portion 13 is engaged, in particular directly carried, by the tab 8 of the closure system 7. Advantageously, the first coupling portion 13 is carried exclusively, but not limitedly, by the coupling portion 10 of the tab 8: the two portions 10 and 13 are advantageously integrally joined to form a single body. In fact, the first coupling portion 13 includes a body of flat sheet emerging, in particular without interruption, from the coupling portion 10 as opposed to the closure portion 9: the coupling portion 10 is therefore interposed between the closure portion 9 and the first coupling portion 13. The first coupling portion 13, in the closed condition of the system 7 and therefore during the insertion of the coupling portion 10 in the volume 3, is configured to also fit into the internal volume 3.

The body of sheet material of the first coupling portion 13 extends between a first and a second prevailing development surface 13*a*, 13*b* (FIG. 20) respectively facing the same direction as the first and second surfaces 10*a*, 10*b* of the coupling portion 10: the first surfaces 10*a*, 13*a* are seamlessly connected to each other and are directly facing the upper wall 4*a* opposed to the lower wall 4*b* connected and directly integrally joined to the system 7. The second surfaces 10*b*, 13*b* are also without interruption and facing the internal volume 3.

Entering more in detail, the first coupling portion 13 of the safety system 12 includes at least one undercut portion delimited by a gripping edge 21 (FIG. 22): the undercut portion, in the first closed condition of the container 1, is configured for engaging the second coupling portion 14 of the safety system 12 arranged in the internal volume. As can be seen, for example, in FIGS. 21 and 22, the gripping edge 21 of the first coupling portion 13 defines a seat whose concavity is directed, at least during the first closed condition of the device 12, at least partially towards the closure portion 9. The seat of the undercut portion defines a substantially "C" shape. FIGS. 21 and 22 show a preferential but not limiting configuration of the first coupling portion 13 which substantially includes two hooks 22 opposed to each other with respect to the first portion 13 itself. In this condition, the first portion 13 therefore includes two respective undercut portions which, at least in the first closed condition of the container 1, are configured to both engage the second coupling portion 14.

Figure 24:
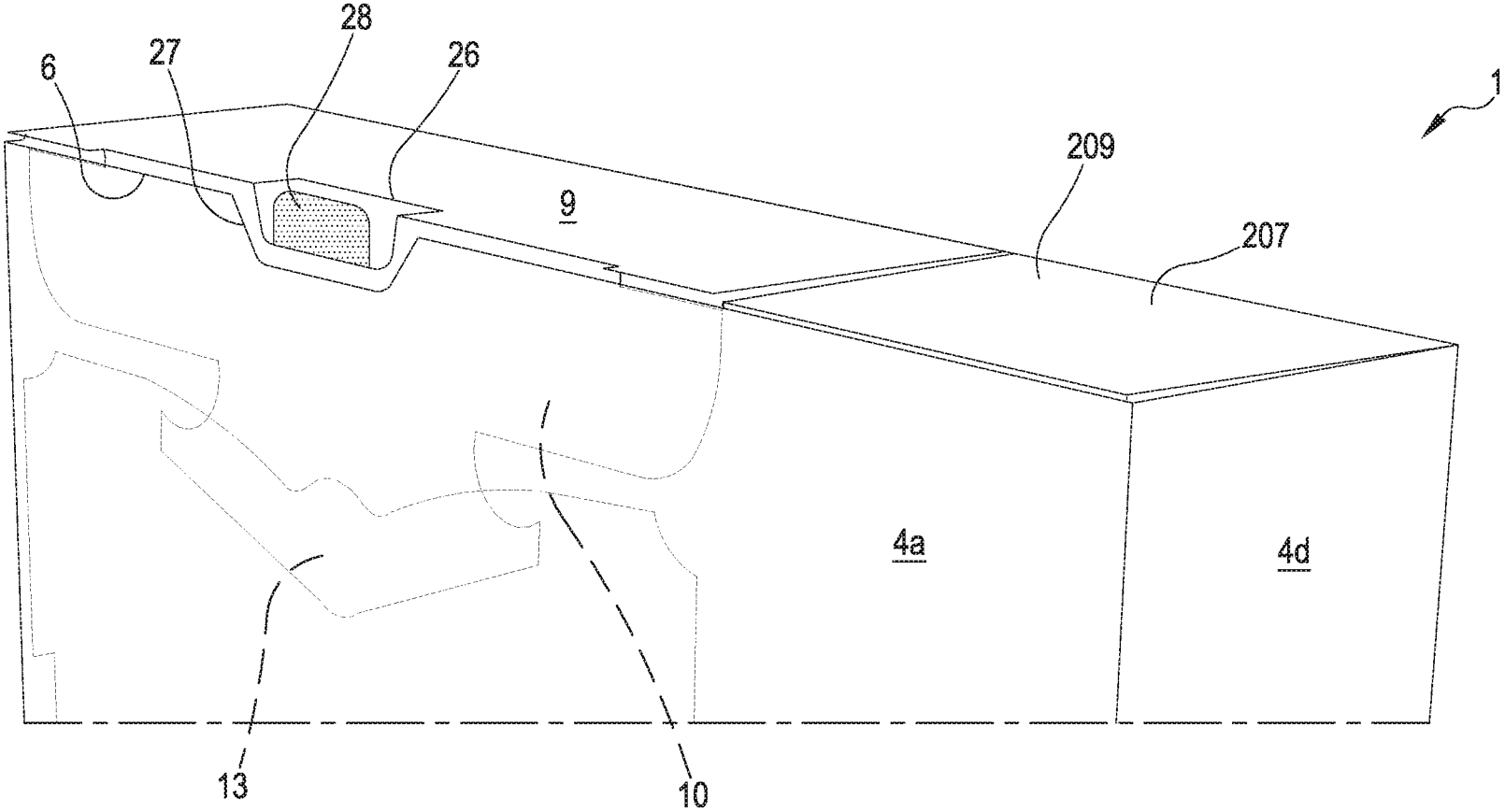

As described above, the second coupling portion 14 of the device 12 is directly engaged in the internal volume 3. In particular, the second coupling portion 14 is directly connected to at least one lateral wall 4 (in particular to the front lateral wall 4*a*) and develops parallel to the latter: the coupling portion 14 is configured to directly face the coupling portion 10 at least during the closed condition of the system 7. In fact, the coupling portion 14 develops parallel to the lateral wall 4 opposite the wall directly connected (integrally joined) to the closure system 7. As can be seen, for example, in FIGS. 22 and 24, the second coupling portion 14 is joined to the front wall 4*a*.

The second portion 14 substantially defines a sheet engaged, in particular integrally joined, internally to one or more walls 4. The body of sheet-material of the second coupling portion 14 extends between a first and a second prevailing development surface 14*a*, 14*b* (FIG. 20) respectively facing towards the outside and towards the inside of the volume 3: the first surface 14*a* of the portion 14, at least in the closed condition of the system 7, is parallel and facing like the first surfaces 10*a*, 13*a* (first surfaces 10*a*, 13*a*, 14*a* directly facing the front wall 4*a* opposed to the rear wall 4*b*).

In the configuration shown in the accompanying figures, the second coupling portion 14 includes, without limitation, the removable portion 15 made of sheet material which extends between a first and a second surface 15*a*, 15*b* (FIG. 20) respectively facing the front wall 4*a* and the rear surface 4*b*: the surfaces 15*a*, 15*b* of the removable portion 15 substantially represent extensions of the surfaces 14*a*, 14*b* of the second coupling portion 14. The removable portion 15 includes at least one undercut portion which is configured to engage, in the first closed condition of the safety device 12, the respective undercut portion of the first coupling portion 13 of the safety system 12.

As can be seen in FIG. 22, the undercut portion of the removable portion 15 is delimited by a respective gripping edge 17, optionally having a substantially "C" shape, which, in the first closed condition of the container 1 itself, is distinct and spaced from the free edge 6: the above undercut portion is internal to the volume 3 and spaced from the through opening so that the removable portion 15 can engage, in the first closed condition, the respective undercut portion of the first coupling portion 13 of the safety system 12.

In greater detail, it is possible to see that the gripping edge 17 of the removable portion 15, in the first closed condition of the container 1 itself, is interposed between the free edge 6 and the respective gripping edge 21 of the first coupling portion 13.

As described above, the first and second coupling portions 13, 14 of the safety device 12 are configured to define a first closed condition substantially defined by the first engagement/coupling of said portions. Prior to the first closing condition, the first coupling portion 13 is arranged out of the internal volume 3 while the second coupling portion 14 lies in the volume (condition shown in FIG. 24). Subsequently, the closure system 7 is guided for the first time in volume 3: during this step, the system 12 is configured to define the closed condition of the container 1 and at the same time there is the first engagement between the first and second coupling portion 13, 14. In fact, during the first closed condition of the container 1, the gripping edge 17 of the removable portion 15 engages the hook 22 of the first coupling portion 13: the first closed condition is illustrated in FIG. 22 by a view from inside of the volume 3 while the FIG. 21 shows the same condition of first closing by a view external to the container 1. In the closed condition, the gripping edge 17 of the removable portion 15 is abutted and stably engaged to the hook 22 of the first portion 13: in this condition, the first portion 13 is entirely inserted inside the seat 17 of the removable portion 15 and respective undercuts define a condition of stable engagement between the coupling portions 13 and 14 of the safety system 12.

The second coupling portion 14 of the safety system 12 includes a support element 16 (FIG. 23), carried by the second coupling portion 14 itself. The support element 16 is joined, in particular integrally joined according to the embodiment shown in the accompanying figures, to the second coupling portion 14 by an edge 19, as shown in FIG. 20, and has a first surface 16*a* facing, during the first closed condition, partly to the surface 15*b* of the removable portion 15 and partly to the surface 13*b* of the first coupling portion 13 of the safety system 12. The support element 16 includes a control portion 28, whereby the support element 16 is interposed between the edge 19 and the control portion 28.

It is useful to note, for example in FIG. 21, that the recess 27 is advantageously arranged at the removable portion 15 of the safety device 12 and at the coupling portion 10 of the tab 8. The recess 27 is configured to allow display of the removable portion 15, in particular of the first surface 15*a*, prior to the first opening condition of the container 1 (during the first closed condition of the container 1); the recess 27 is also configured to allow display of the control portion 28 (see, for example, FIG. 24), in particular of the first surface 28*a*, then the first opening condition of the container 1 to show evidence of tampering with the container 1.

In an embodiment of the coupling system 12, the first coupling portion 13, during the first closed condition of the container 1, passes rearwardly with respect to the removable portion 15 (the surface 15*a* then faces directly to the lateral wall 4*a* while the surface 10*a* faces the surface 15*b*): in this way, the opening 26 can be removed and the recess 27 is configured to allow display of the removable portion 15, in particular of the first surface 15*a*, prior to the first opening condition of the container 1 (during the first closing condition of the container 1); the recess 27 is also configured to allow display of the coupling portion 10, in particular of the surface 10*a*, subsequent to the first opening condition of the container 1 to show evidence of tampering with the container 1.

The stable engagement between the removable portion 15 and the first coupling portion 13 opposes the opening of the container 1; at the first opening, the user feels a strong resistance to opening the container to show that the latter has not been opened for the first time. The safety device 12, during the first opening condition, is configured to allow detaching the removable portion 15 from the second coupling portion 14. The first opening condition is illustrated, for example, in FIG. 21: during the first opening of the system 7, the first coupling portion 13 grips the removable portion 15 (taken between hooks 18 and 22) and tears it from the second portion 14.

Following the first opening condition, the device 12 is able to give evidence of tampering since the opening of the system 7 is facilitated: the user does not perceive, during the opening, a resistance on the coupling portion 10. Moreover, subsequently to the first opening condition, the recess 27 and the opening 26 allow displaying the control portion 28 in place of the removable portion 15 (see FIG. 24 in which the absence of the removable portion 15 is clear): in this condition, the user can easily notice tampering with the container 1 without opening the same. Advantageously, it is possible to differentiate the surfaces 15*a* and 28*a* respectively of the removable portion 15 and of the control portion 28 in such a way as to favor the recognition of said surfaces and thus accentuate the evidence of tampering. For example, it is possible to provide different colors of the surfaces 15*a* and 28*a*: in this way, the user can recognize the tampering of the container 1 only by recognizing the color of the control portion 28 rather than the removable portion 15.

It is useful to specify that the solution described above represents a preferential but non-limiting configuration of the container 1. In fact, the removable portion 15 could indiscriminately constitute at least part of the first and/or second coupling portion 13, 14. For example, the removable portion 15 could define the hook 22 of the first coupling portion 13: in this case, during the first opening of the container, the removable portion 15 would be configured to detach from the first portion 13. As described above, the possibility of defining at least a removable portion 15 on the first coupling portion 13 and at least a removable portion on the second coupling portion 14 is not excluded.

A further embodiment, not shown in the accompanying figures, includes the possibility of completing the first closed condition by engaging the first coupling portion 13 with the second coupling portion 14 so that the removable portion 15 is interposed between the coupling portion 10 of the closure system 7 and the front wall 4*a* of the container 1. In this case, the surface 15*a* of the removable portion 15 is directly facing the wall 4*a* of the container 1 while the surface 15*b* of the removable portion 15 faces the surface 10*a* of the coupling portion 10. The opening 26 on the tab 8 is therefore optional so that, prior to the first opening condition, the recess 27 allows exposure of the surface 15*a* of the removable portion 15 while, subsequently to the first opening condition, the recess 27 allows exposing at least part of the surface 10*a* to show evidence of tampering with the container 1. In this further embodiment, it is possible to provide a different coloring of the surface 10*a* with respect to the surface 15*a*: in this way, the user can recognize the tampering of the container 1 only by recognizing the color of the surface 10*a* rather than the removable portion 15.

According to the preferred embodiment shown in FIGS. 21 and 22, the removable portion 15 can include at least one protrusion 25 perceptible to the touch emerging from the internal volume 3 and/or through the recess 27 and/or the opening 26: the removable portion 15, together with the protrusion 25, is configured to detach from the safety device 12 following a first opening condition of the closure system 7 subsequent to the first closed condition to show evidence of tampering with the container 1.

In greater detail, the protrusion 25 of the removable portion 15, in the first closed condition of the closure system 7 and prior to the first opening condition of the container 1, lies on a plane parallel to the coupling portion 10 and protrudes from the free edge 6, in particular transversely with respect to the closure portion 9. In further detail, the protrusion 25, in the condition of first closing of the closure system 7 and prior to the first opening condition of the container 1, is configured to be arranged a the recess 27 and emerge beyond the latter and/or beyond the free edge 6. In fact, the protrusion 25, in the first closing condition of the closure system 7 and prior to the first opening condition of the container 1, is configured to remain substantially flush with the closure portion 9 of the tab 8 or is configured to emerge transversely from said closure portion 9; in any case, the protrusion 25, in both configurations, is adapted to be perceptible to the touch in such a way that the same can be distinguished from the closure portion 9 of the free edge 6 and from the recess 27.

From the geometrical profile, the protrusion 25 has, according to a front view orthogonal to the lying plane of the same protrusion 25, a shape selected from the group including: triangular, square, rectangular, trapezoidal, semicircular, elliptical. In a preferential but non-limiting embodiment of the container 1, the protrusion 25 has, according to a front view orthogonal to the lying plane of the same protrusion 25, a tapered shape, in particular triangular, extending from the free edge 6: the tapered shape of the protrusion 25 is configured to facilitate the tactile perception thereof during the first closing condition of the closure system 7 and prior to the first opening condition of the container 1. The tapered shape and the elevation of the protrusion relative to at least the free edge 6 of the container 1 allow an easy and rapid tactile perception of the same protrusion, for example, when a finger passes over the closure portion 9 of the tab 8.

The protrusion 25 carried by the removable portion 15, in the first closing condition of the device 7 and prior to the first opening condition of the container 1, is spaced and arranged in opposition to the gripping edge 17 with respect to the removable portion 15; in particular, the protrusion 25 emerges on the opposite side to the gripping edge 17 with respect to the removable portion 15 and as described above emerges from the free edge 6. In fact, the second portion 14, in the first closing step of the device 7 and prior to the first opening step of the container 1, remains entirely inside the volume 3 together with the removable portion 15: only the protrusion 25 of the removable portion 15 emerges at least partly from volume 3 and in particular beyond the free edge 6.

In the case in which the removable portion 15 is between the lateral wall 4 of the container 1 and the coupling portion 10 of the tab 8, the protrusion 25, in the first closing condition of the device 7 and prior to the first opening condition of the container 1, emerges from the free edge 6 between the tab 8 and the lateral wall 4, in particular directly facing the surface 10*a* of the coupling portion 10. Vice versa, in the case in which the removable portion 15 is located behind the coupling portion 10, the protrusion 25 is configured to be arranged inside the opening 26 of the tab 8; preferentially, in this condition, the protrusion 25 crosses at least partly the through opening 26 to emerge from the free edge 6 and optionally also from the closure portion 9 of the tab 8 (FIG. 20).

As described above, the container 1 includes a recess 27—preferably carried by the lateral wall 4 parallel to the second coupling portion 14 of the safety device 12 and directly facing the coupling portion 10—designed to substantially define a lowering of the free edge 6; the recess 27 allows a better visibility of the protrusion 25 from the free edge 6 following the first closing condition and prior to the first opening condition. In fact, the recess 27 is adapted to allow both the display and the tactile perception of the protrusion 25. Following the first opening of the container 1, the removable portion 15 detaches from the container (more generally from the container 1) and with it also the protrusion 25, which is no longer perceptible to the touch. The absence of the protrusion 25 can immediately give evidence of tampering with the container even without visual evidence. In the preferred embodiment, the control portion 28 is entirely contained in the internal volume 3 and is directly covered by the removable portion 15, in a condition prior to a first opening. In particular, the control portion 28 is configured to position immediately behind the protrusion 25 emerging from the free edge 6. In fact, the top of the control portion 28 is configured to remain within the volume 3 at the free edge 6. The control portion 28 is configured to arrange, following the first opening condition of the container 1, behind the coupling portion 10 so that the latter is interposed between said control portion 28 and the lateral wall 4*a* abutted to the coupling portion 10; in this condition, the control portion 28 is entirely contained in the internal volume 3 and faces the through opening 26 of the closure system 7.

In the embodiment shown in the accompanying figures, the control portion 28 is carried, by way of non-limiting example, directly by the front lateral wall 4*a* and includes a sheet lying parallel to the second coupling portion 14; in particular, the control portion 28 is, without limitation, integrally joined and parallel to the second coupling portion 14 of the safety device 12.

Figure 8:
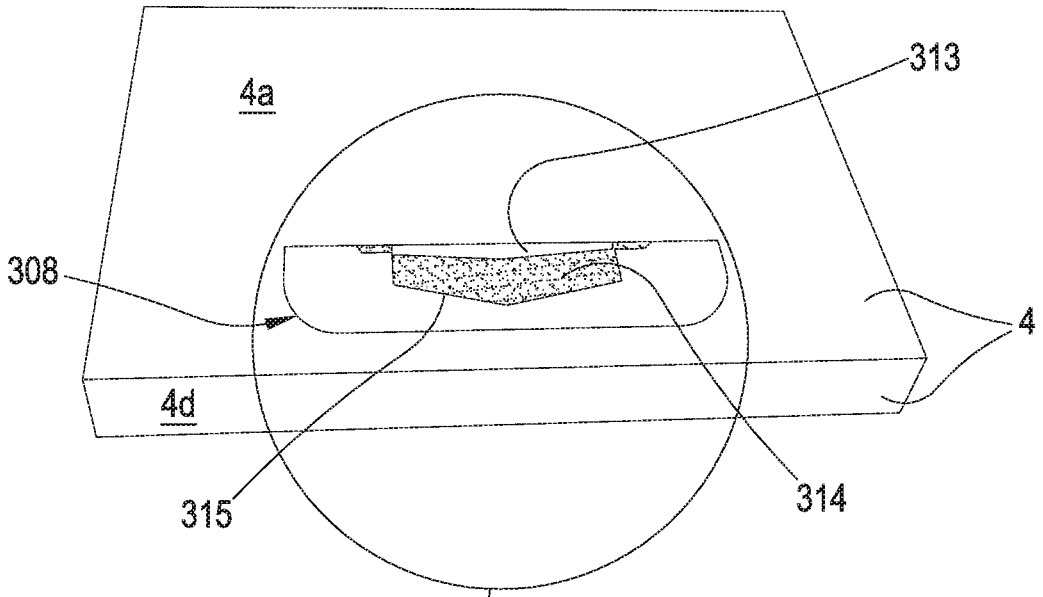
FIG. 8 is a perspective view of a container of the package according to the present invention.

As can be seen, for example, in FIG. 8 and as described above, the container 1 includes at least a second coupling portion 308 suitable for ensuring a reliable connection with the first coupling portion 307 of the case 102, at least during the first operative position. In particular, the second coupling portion 308 is integral with the container 1.

In a non-limiting embodiment of the invention, the coupling portion 308 includes a pocket 314 (FIG. 8) defined on a lateral wall 4, in particular on the front lateral wall 4*a* of the container 1. The pocket 314 is delimited by a closure edge 315 and is adapted to receive the first coupling portion 307 of the case 102 in engagement—at least in the first operative position of the container 1. The closure edge 315 defines an undercut with the first coupling portion 307, more precisely with the lateral stop element 309 (for example the two stop elements 309) of the first coupling portion 307, at least during the first operative position of the container 1. According to the preferred embodiment and illustrated in the accompanying figures, the first coupling portion 307 is inserted inside the pocket 314 during the first and second operative positions of the container 1.

Figure 8A:
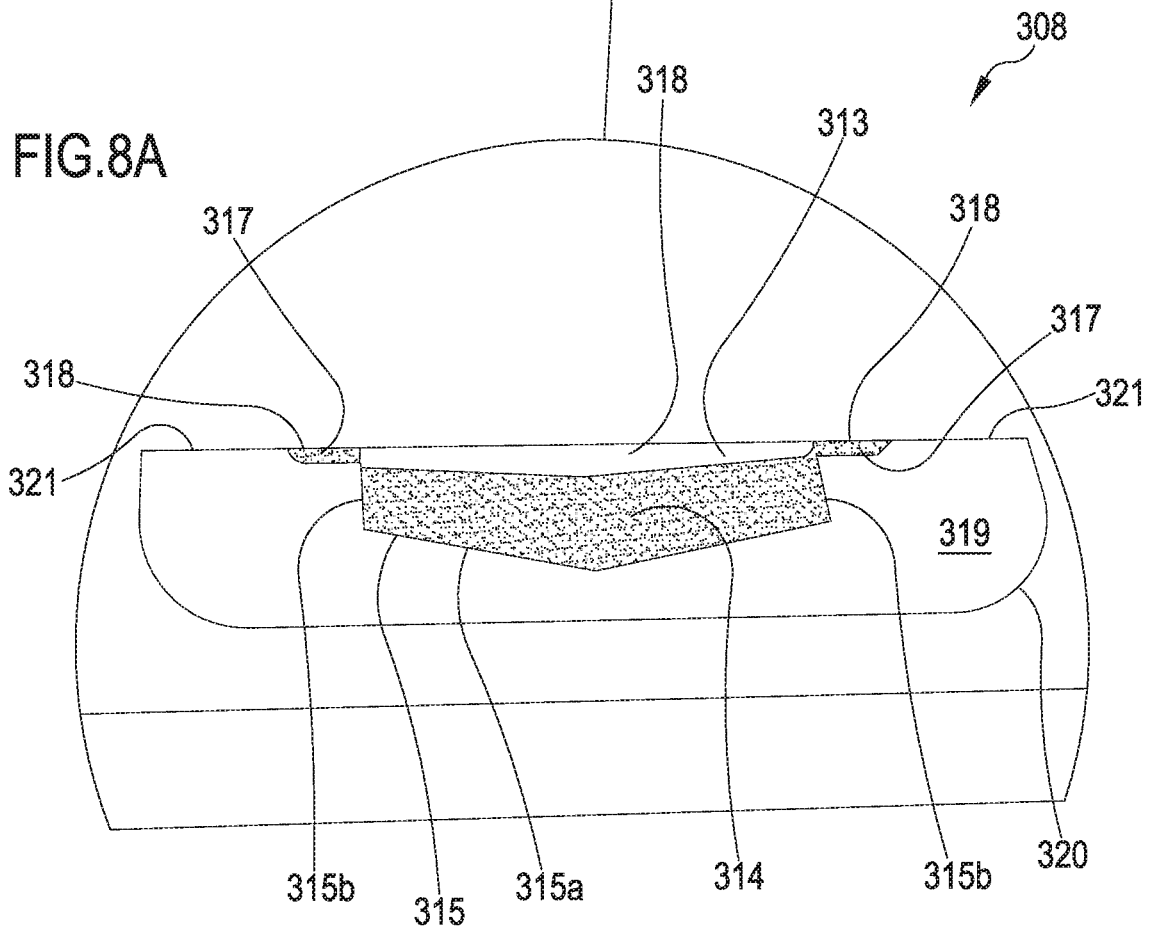
FIG. 8A is a detailed view of the container in FIG. 8.

The second coupling portion 308 includes at least one cut 317 (FIG. 8A) in direct communication with the pocket 314. Said cut 317 is configured to allow the release of the first 307 and of the second 308 coupling portion, in particular allows the release of the lateral stop elements 309, engaged by undercut with the closure edge 315, thus allowing the switching of the container 1 from the first to the second operative position of the container 1. According to the preferred embodiment, the container 1 has two cuts 317 opposed to each other and both in direct communication with the pocket 314 (FIG. 8A). The pocket 314 is also delimited by a trailing edge 318, directly connected to the closure edge 315 and adjacent to the cuts 317. The closure edge 315 is defined by a predetermined width, measured in a direction orthogonal to a direction of insertion of the first coupling portion 307 in the pocket 314, while the trailing edge 318 measures—always according to a direction orthogonal to the insertion direction of the first coupling portion 307 in the pocket 314—a predetermined width greater than the width of the closure edge 315. The closure edge 315 includes in turn at least one leading edge 315*a* and at least one lateral edge 315*b* (FIG. 8A), in particular includes two lateral edges 315*b* opposite and parallel to each other, whose measured distance is equal to the width of the closure edge 315. The undercut defined between the first coupling portion 307 and the second coupling portion 308 is due to the fact that the first coupling portion 307 has—according to a direction orthogonal to the direction of insertion of the same first coupling portion 307 into the pocket 314—a predetermined maximum width, in particular measured at the lateral stop element 309, greater than the width of the closure edge 315. The lateral stop elements 309 therefore exceed in width with respect to the opposed lateral edges 315*b*, forcing the first coupling portion 307 to abut against the leading edge 315*a* and preventing the first coupling portion 307 from disengaging. In contrast, the trailing edge 318 has—always according to a direction orthogonal to the direction of insertion of the first coupling portion 307 in the pocket 314—a predetermined width greater than the width of the closure edge 315, and in particular a width slightly greater than that measured at the lateral stops 309 of the first coupling portion 307. The greater width of the trailing edge 318 with respect to the width measured at the lateral stops 309 of the first coupling portion 307 allows the release of the lateral stops 309 and therefore the switching of the container 1 from the first to the second operative position. The width, again measured according to a direction orthogonal to the direction of insertion of the first coupling portion 307 in the pocket 314, of the auxiliary lateral stop elements 309*a* is equal to that of the lateral stop elements 309, according, without limitation. to the preferred embodiment. The pocket 314 is therefore exclusively delimited by the closure edge 315 and the trailing edge 318.

The first coupling portion 307 has a width, measured not at the lateral stop elements 309 or the auxiliary lateral stop elements 309*a*, equal to or slightly smaller than the width of the closure edge 315. This limitation allows the first coupling portion 307 to be guided by the lateral edges 315*b* during the movement of the container 1 in the switching between the first and second operative position, so that the lateral stop elements 309 are in the correct position with respect to the trailing edge 318 during the release of the first coupling portion 307 from the second coupling portion 308.

Figure 9:
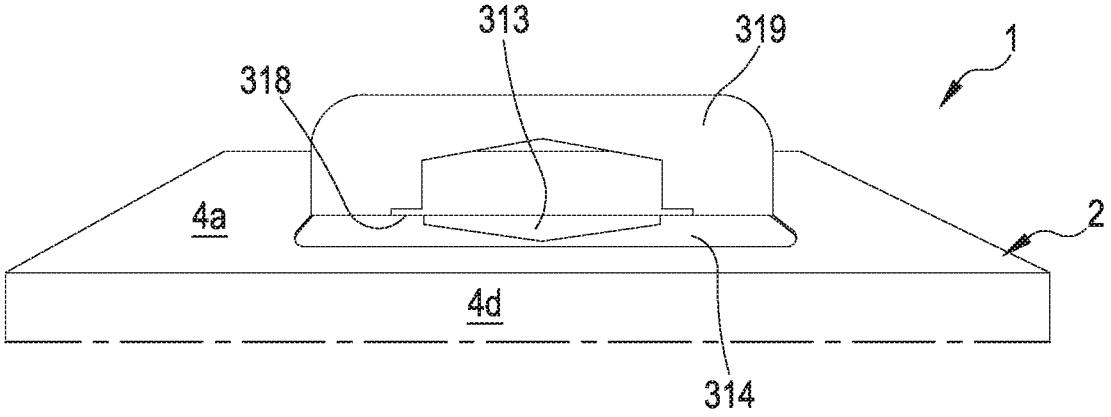
FIG. 9 is a further perspective view of a container of the package according to the present invention.

The second coupling portion 308 may include at least one coupling tab 319 delimited by the edge 315, a cutting edge 320 and a connecting edge 321 (FIG. 8A). The coupling tab 319 is carried by the front wall 4*a* of the container 1, in particular it is integrally joined, according to the preferred embodiment but without limitation, to said front wall 4*a*. The cutting edge 320 physically divides the coupling tab 319 from the front wall 4*a*, allowing the possibility of movement by rotation of the coupling tab 319 itself around the connecting edge 321 (see, for example, FIG. 9). Said connecting edge 321 joins, in particular integrally, the coupling tab 319 with the front wall 4*a* of the container 1. The presence of said movable coupling tab 319 facilitates the insertion of the first coupling portion 307 of the case 102 inside the pocket 314 of the container 1, especially facilitating the first insertion during the assembly of package 100.

As described above, the first coupling portion may further include one or more auxiliary stop elements 309*a*; following the release of the stop element 309, the container can move from the first to the second operative position: in the second operative position, the auxiliary stop element 309*a* is able to abut to the closure edge 315 in such a way as to prevent the total extraction of the container from the case. In this condition, at least a part of the container is arranged in the case while a part of the container is arranged outside the internal volume 103.

The first and second coupling portion essentially define a coupling system 301 active between the case 102 and the container 1 and adapted to define the above two operative positions, in order to allow or prevent access to the container 1 by the end user.

Figure 26:
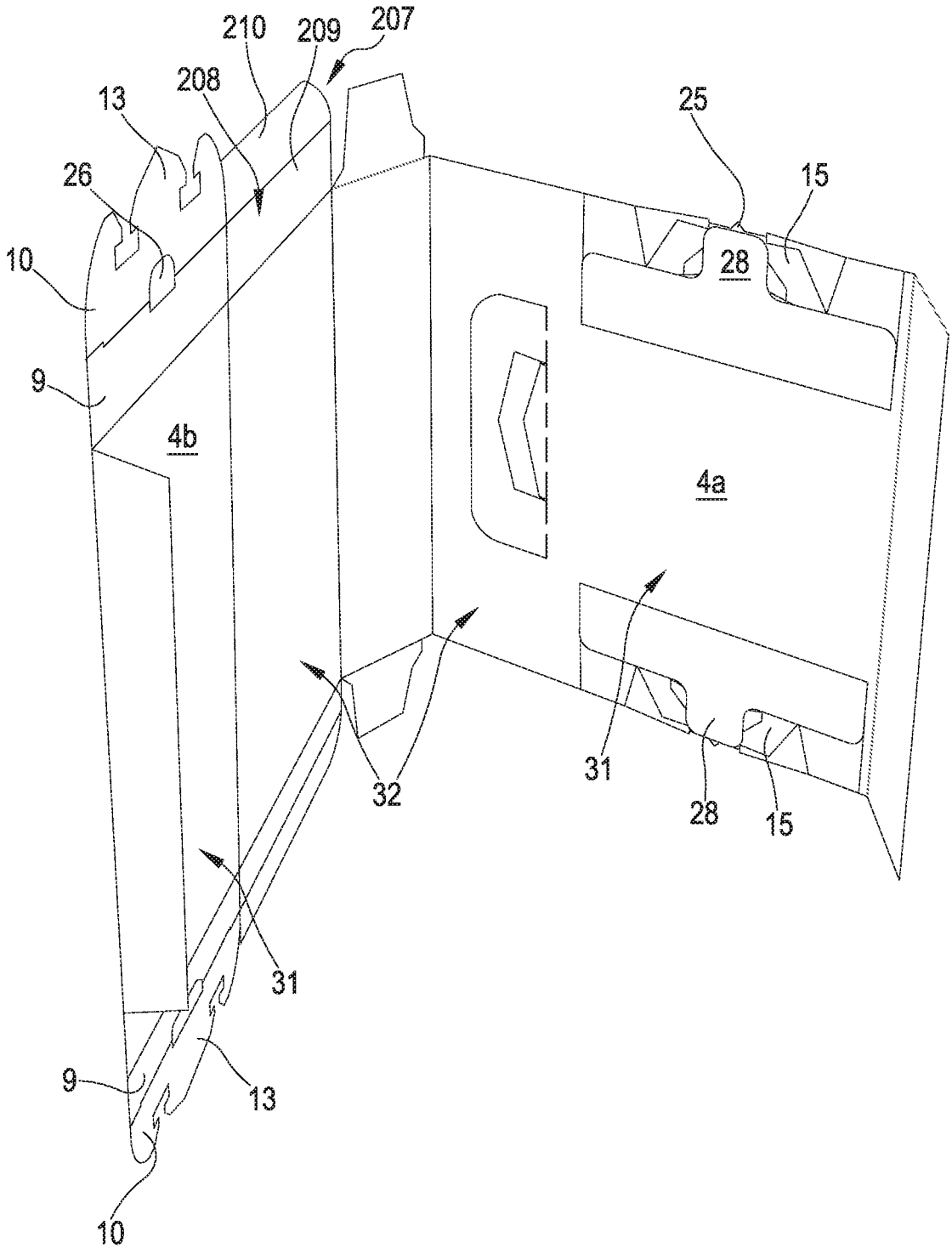
FIG. 26 is a perspective view schematically showing a step of folding the semi-finished product for making the container of a package according to the present invention.

In fact, the container 1 can be ideally divided into a first operative portion 31 and a second operative portion 32, which define two different areas of the container 1 (see, for example, FIGS. 21 and 26). The first operative portion 31 is delimited by the free edge 6 adjacent to the opening 5 and by the lateral wall 4*c* of the container 1, so that said first operative portion 31—in particular both portions 31 and 32—is defined inside the internal volume 103 of the case 102 during the first operative position of the container 1, while it is defined outside the internal volume 103 of the case 102 during the second operative position of the container 1. In practice, the operative portion 31 represents the portion of the container 1 that can be extracted from the case 102, during the switching of the container 1 from the first to the second operative position. Said first operative portion 31 includes the opening 5 and the closure system 7, as well as, in the preferential embodiment, the safety system 12, being therefore suitable for housing the product.

The second operative portion 32 is delimited by the free edge 6 and by the lateral wall 4*d* of the container 1, and being defined, according to the preferential embodiment, inside the internal volume 103 of the case 102 during the first and second operative positions of the container 1. The second operative portion 32 represents the portion of container 1 configured to remain inside the internal volume 102 of the container 1 during the first and second operative positions of the container 1. Said second operative portion 32 includes the second coupling portion 308, the latter being adapted to receive the insertion of the first coupling portion 307 during the first and/or the second operative position of the container 1. The second operative portion 32 of the container 1, being kept inside the case 102 and being counter-shaped to the case 102 itself, helps to maintain the coupling between container 1 and case 102 stable, in particular during the second operative position of the container 1, during which the first operative portion 31 is outside the case 102.

The coupling system 301 further includes at least one thrusting element 313 active between the first 307 and the second coupling portion 308 of the coupling system 301: the thrusting element is configured to maintain the stable engagement between the first 307 and the second 308 coupling portion during the first and second operative positions of the container 1. The thrusting element 313 is configured to apply a thrust on the first coupling portion 307 so that the engagement between the portions 307 and 308 can be guaranteed; in particular, the thrusting element 313 is configured to push the protrusion of the first coupling portion 307 towards the container 1, optionally according to a direction entering the container 1. In fact, the thrusting element 313 is configured to act in thrust on the first coupling portion 307 along a transverse direction, particularly substantially orthogonal, to the predetermined extension direction D of the first coupling portion 307. More precisely, the thrusting element 313 imposes a pressure action on the first coupling portion 307 by pushing said first coupling portion 307 towards the closure edge 315, in particular towards the leading edge 315*a* of the closure edge 315, ensuring a reliable engagement between the first coupling portion 307 and the second coupling portion 308. The thrusting action, according to the preferred embodiment but not limited thereto, is due to the folding process of the thrusting element 313 towards the inside of the container, and therefore is a consequence of the stiffness of the paper sheet material of which it is composed.

The thrusting element 313, distinct from the first and second coupling portions 307 and 308, is carried by the front wall 4*a* of the container 1, in particular it is placed at the second coupling portion 308, more precisely it is placed at the trailing edge 318. More precisely, the thrusting element 313, made of paper sheet material, is integrally joined to the front wall 4*a* of the container 1 and folded towards the inside of the container 1 to form a protrusion emerging from the trailing edge 318 and defining the pocket 314. The thrusting element 313 has a width comparable with that of the first coupling portion 307. In particular, according to the preferred embodiment, the thrusting element 313 has a width equal to the width of the closure edge 315, and therefore as already said, to that of the first coupling portion 307. The thrusting element 313 extends inside the container 1 by a length between 2 mm and 20 mm, more precisely between 5 mm and 10 mm.

The thrusting element 313 essentially includes a tab (advantageously but not limited to paper material) integrally joined to the lateral wall 4*a* of the container 1; the tab is carried by the second portion 32 which, as described above, is placed in the first and second operative position of the container inside the case 102.

The coupling system 301 is configured in such a way as to constrain the container 1 to the case 102 and is active between the above elements, allowing the container 1 to switch from the first to the second operative position.

In a non-limiting embodiment of the package 100, the latter may include an opening device 160 adapted to act on the coupling system 301 to allow the container 1 to be released from the case 102 and its consequent switching from the first to the second operative position. The opening device 160 (see for example FIGS. 6 and 7) may include a body of sheet material—for example a tab—configured to be inserted inside the volume 103 of the case 102 through the slit 150, at the free edge 106 and of the base portion 311 of the first coupling portion 307 (see, for example, FIG. 16). The opening device 160 is inserted, due to its reduced thickness, between the front wall 104*a* of the case 102 and the container 1, more particularly the opening device 160 slides between the first coupling portion 307 and the front wall 4*a* of container 1. The opening device 160 can be inserted according to an angle $\alpha$ (FIG. 7) in the range $20° < \alpha < 89°$. Continuing the insertion, the opening device 160 is partially inserted inside the pocket 314 of the container 1, being guided during the insertion itself by the closure edges 315*b*. During this insertion step of the opening device 160, the latter contacts, during the first operative position, the two lateral stop elements 309 of the first coupling portion 307. The advancement of the opening device 160 allows the latter to move the lateral stop elements 309 at the cut 317 defining the trailing edge 318 which—in this position—can disengage from the portion 308 and the consequent switching of the container 1 from the first to the second operative position. During said second operative position of the container 1, the auxiliary lateral stop elements 309*a* define an auxiliary undercut with the closure edge 315, preventing the complete release of the container 1 from the case 102. During said second operative position of the container 1, the presence of the case does not allow insertion of the opening device 160, thus preventing the release of the auxiliary lateral stop elements 309*a* and therefore an accidental total removal of the container 1 from the case 102.

In the accompanying figures, an opening device 160 is illustrated without limitation, having a rectangular or square shape in which two dimensions of width and length are much larger than the third thickness dimension. Visually, the opening device 160 is similar in size to that of a card. According to a preferred but non-limiting embodiment, the opening device 160 is made of sheet material, in particular of paper sheet. In a further embodiment, the opening device 160 may be made of a polymeric material. In terms of size, the opening device 160 has a length of between 4 cm and 25 cm, more particularly between 6 cm and 16 cm, has a width of between 2 cm and 12 cm, more particularly between 4 cm and 9 cm, has a thickness between 0.4 mm and 3 mm, more particularly between 0.7 mm and 2 mm. These dimensional values are indicative and may therefore be subject to change if deemed necessary.

Manufacturing Procedure of the Package

Another object of the present invention is a method for manufacturing a package according to one or more of the accompanying claims and/or to the description given above.

The process provides for a step of arranging the case 102. The step of arranging the case 102 first includes a step of arranging a first semi-finished product 500 of sheet material, in particular in paper sheet material, including a first sheet 501, made of paper sheet material, including at least a first and a second portion 502, 504 interconnected by a central connecting portion 503. The first sheet 501 further includes, at its longitudinal ends, at least a first and a second lateral connecting portion 505, 506. The first portion 502 is interposed between the first lateral connecting portion 505 and the central connecting portion 503 while the second portion 504 is interposed between the central connecting portion 503 and the second lateral connecting portion 506. Each of the portions 502, 503, 504, 505, 506 defines a first and a second longitudinal edge opposed to each other so that said portions 502 and 504, the central connecting portion 503 and said lateral connecting portions 505, 506 are joined along the longitudinal edges, in particular joined together, and aligned along a single connecting direction. Each of the portions 502, 503, 504, 505, 506 also define a first and a second end edge 525, 526 opposed and spaced from each other, as well as orthogonal to the first and second longitudinal edges mentioned above.

The first sheet 501 further includes a second sheet 521 connected and integrally joined to one of the above edges 525, 526 above. In particular, the sheet 521 is integrally joined to the first or second portion 502, 504 of the first sheet. The sheet 521 further includes a second portion 522 integrally joined and emerging from the lateral edges of the latter.

The semi-finished product as described above is, for example, obtained by means of a cutting step of a starting sheet. This cutting step allows defining the outer contour and the through recesses 29 and 127 of the first sheet; an outer contour of the second sheet. Following the cutting step, the process includes the step of folding and gluing the first flat semi-finished product which include the following sub-steps in detail:

- folding the second sheet 521 on the first and/or second portion 502, 504 of the first sheet 501, along the end edge 525 or 526, to define the first coupling portion 307 inside the case 102,
- gluing the second portion 522 of the second sheet 521 onto the first and/or second portion 502, 504 of the first sheet 501,
- folding the first sheet 501 along the longitudinal edges of the portions 502, 503, 504, 505, 506 of the same sheet to define the side walls 104 of the case 102,
- reciprocal gluing of the adhesion surfaces 510, 511 of the portions 505-506, to define the through openings 105 and 105*a*.

Figure 27:
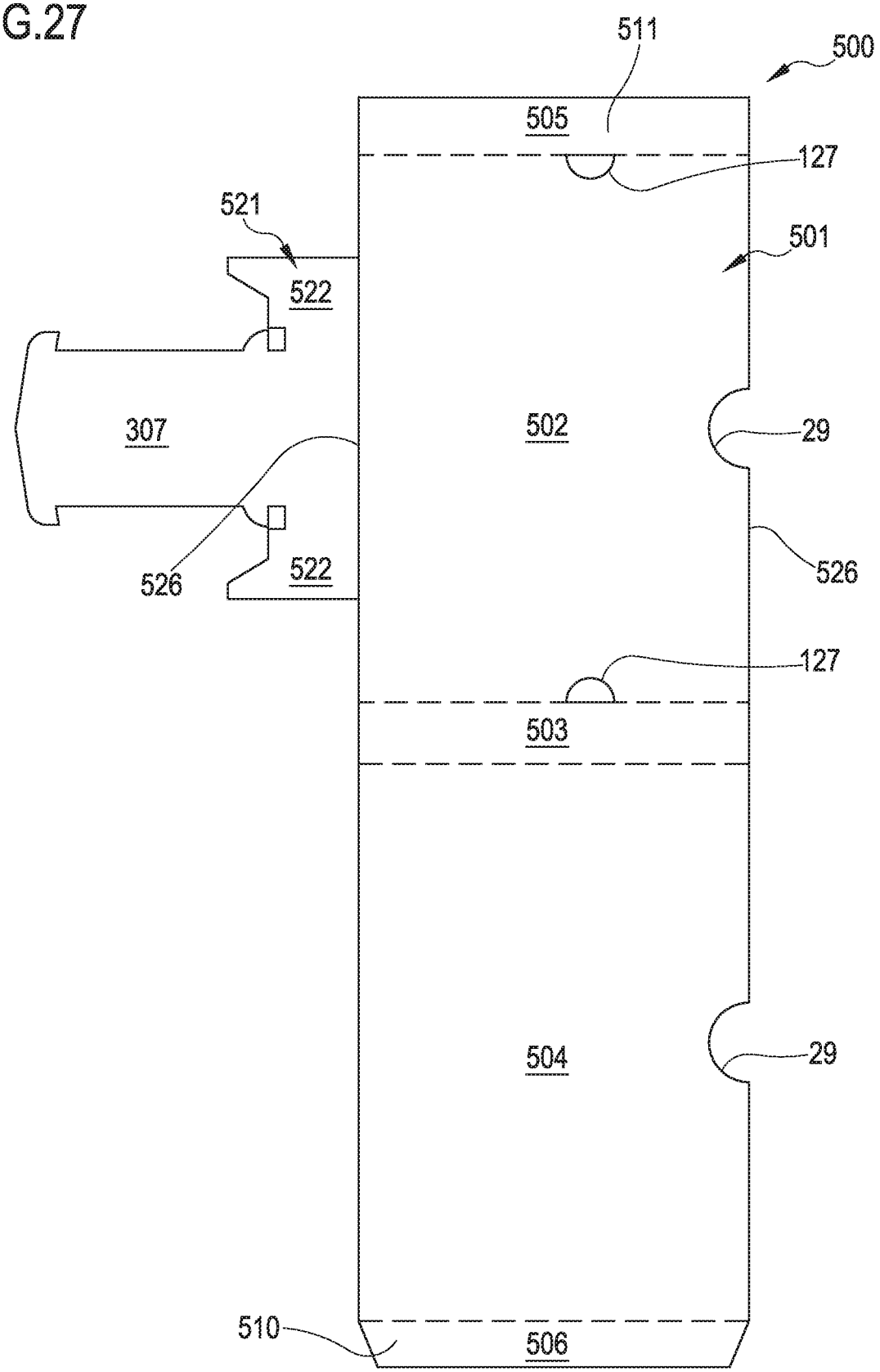
FIG. 27 is a top view of a flat semi-finished product for making a case of the package according to the present invention.

The gluing takes place by applying a predetermined quantity of glue or adhesive material at the adhesion surfaces 510, 511 of the portions 505-506 and at the second portion 522 of the second sheet 521. The gluing of the second portion 522 of the second sheet 521 onto the first and/or second portion 502, 504 of the first sheet 501, subsequent to the folding of the second portion 522 itself along the end edge 525, imposes to the first coupling portion 307 an extension direction D towards the opposite end edge 526. The cutting of the first sheet 501 and of the second sheet 521 can be carried out advantageously but not limitedly in a single process, in particular a single shearing process can be carried out to define the external perimeter of the semi-finished product 500 in FIG. 27.

The process further includes a step of arranging the container 1. The step of arranging the container first includes a step of arranging a first semi-finished product 500 of sheet material, in particular in paper sheet material, including:

- a first sheet 51, made of paper sheet material, including at least a first and a second portion 52, 54 interconnected by a central connecting portion 53. The first sheet 51 further includes, at its longitudinal ends, at least a first and a second lateral connecting portion 55, 56. The first portion 52 is interposed between the first lateral connecting portion 55 and the central connecting portion 53 while the second portion 54 is interposed between the central connecting portion 53 and the second lateral connecting portion 56. Each of the portions 52, 53, 54, 55, 56 defines a first and a second longitudinal edge opposed to each other so that said portions 52 and 54, the central connecting portion 53 and said lateral connecting portions 55, 56 are joined along the corresponding longitudinal edges, in particular joined together, and aligned along a single connecting direction. Each of the portions 52, 53, 54, 55, 56 also define a first and a second end edge 71, 72 opposed and spaced from each other, as well as orthogonal to the first and second longitudinal edges mentioned above. Said first sheet 51 has on the first portion 52 at least one cut 85*a*, adapted to define the second coupling portion 308 and the thrusting element 313 of the coupling system 301;
- a second sheet 57 connected and integrally joined to one of the above edges 71, 72 above. In particular, the sheet 57 is integrally joined to the first or second portion 52, 54 of the first sheet. Even more particularly, the sheet 57 is integrally joined to the second portion 54 of the first sheet 51 and is part of the closure system 7 of the container 1. The sheet 57 has at least:
  - a first portion 58 directly connected to at least one of the end edges 71, 72. In particular, according to the preferred embodiment, the sheet 57 has two portions 58 directly connected to each of the end edges 71, 72, at the first operative portion 31 of the container 1;
  - a second portion 59 integrally joined to the first portion 58 of the same second sheet 57, wherein said second portion 59 emerges from the first portion 58 so that the latter portion is interposed between the second portion 54 of the first sheet 51 and the second portion 59 of the second sheet 57. In particular, the sheet 57 has two portions 59 each integrally joined to the two previous portions 58.

In a preferential but not limiting embodiment of the method, the second semi-finished product 50 can further include:

- a third sheet 62 including at least a portion 63 integrally joined to the second portion 59 of the second sheet 57, wherein the portion 63 of the third sheet 62 emerges from the second sheet 57 on the opposite side to the first sheet 51. The third sheet 62 is configured to define the first coupling portion 13 of the safety device 12 of the container 1. In particular, the third sheet 62 includes two portions 63, each integrally joined to the two portions 59 of the second sheet 57, at the first operative portion 31 of the container 1. The portion 59 of the second sheet and the portion 63 of the third sheet define the coupling portion 10 of the closure system 7 of the container 1;
- a fourth sheet 64 including at least:
  - a portion 65 integrally joined to the first portion 52 of the first sheet 51 and configured to define the second coupling portion 14 of the safety device 12 of the container 1. In particular, according to the preferred embodiment, the fourth sheet 64 includes two portions 65, each integrally joined to the two end edges 71, 72 of the first portion 52 of the first sheet 51, at the first operative portion 31 of the container 1;
  - a portion 66 integrally joined to said portion 65 by a weakening line 67, being configured to define the removable portion 15, optionally carrying at least one protrusion 25, of the safety system 12 and belonging to the second coupling portion 14. In particular, according to the preferential embodiment, the fourth sheet 64 includes two portions 66, each integrally joined to the two portions 65 of the fourth sheet 64, at the first operative portion 31 of the container 1. The weakening line 67 is configured in such a way as to facilitate the detachment of the removable portion 15 from the second coupling portion, in particular from the portion 65 of the fourth sheet 64, 14 during the first opening of the closure system 7;

a portion 69 integrally joined to said portion 65 by the folding edge 68, being configured to define the support element 16 of the control portion 28 of the safety system 12. In particular, according to the preferential embodiment, the fourth sheet 64 includes two portions 69, each integrally joined to the two portions 65 of the fourth sheet 64, at the first operative portion 31 of the container 1.

Advantageously but not limitedly, the second semi-finished product 50 may further include a fifth sheet 60 having at least one portion 61 connected to at least a central and lateral connecting portion 53 of the first sheet 51 and emerging from the same side from which the second sheet 57 emerges. In particular, according to the preferred embodiment, the fifth sheet 60 includes four portions 61, respectively joined together at the two end edges 71, 72 of the central connecting portion 53 and at the two end edges 71, 72 of the lateral connecting portion 56 of the first sheet 51. Said portions 61 are configured to define, when folded at 90 degrees towards the inside of the internal volume 3 of the container 1, the abutment portions 11.

Advantageously but not limitedly, the second semi-finished product 50 may further include a sixth sheet 80 having at least:

a first portion 81 integrally joined to the second portion 54 of the first sheet 51. In particular, according to the preferred embodiment, the sixth sheet 80 includes two portions 81 integrally joined to the two end edges 71, 72 at the second operative portion 32 and included between the central connecting portion 53 and the second sheet 57. The first portion 81 is configured so as to define the closure portion 209 of the occlusion system 207;

a second portion 82 integrally joined to the first portion 81 of the sixth sheet 80 such that the first portion 81 is included between said second portion 82 of the sixth sheet 80 and the second portion 54 of the first sheet 51. In particular, according to the preferred embodiment, the sixth sheet 80 includes two portions 82, each integrally joined to the corresponding first portion 81. The second portion 82 is configured to define the coupling portion 210 of the occlusion system 207.

The second semi-finished product 50 can be obtained by means of a cutting step of a starting sheet; in particular, during a single cutting operation it is possible to obtain the first and second sheets 51, 57 and optionally, if present, the third, fourth, fifth and sixth sheets (62, 64, 60, 80). In particular, by cutting the second semi-finished product it is possible to obtain:

an outer contour of the first sheet 51, the recess 27, the cut 85*a*, defining the second coupling portion 308 and the thrusting element 313 of the coupling system 301, the contour of the second sheet 57, optionally, a dividing line with the adjacent sixth sheet 80, in particular with the portions 81 and 82, the through recess 26, the contour of the third sheet 62, optionally the outer contour of the first coupling portion 13 of the safety system 12, the contour of the fourth sheet 64 and in particular the removable portion 15 and the weakening line 67, optionally the contour of the fifth sheet 60, optionally the outer contour of the sixth sheet 80 so as to define the outer contour of the occlusion system 207.

Following the cutting of the semi-finished product 50, the method provides for the steps of folding and gluing of the latter to obtain the container 1; in particular, these steps include:

folding the portion 65 of the fourth sheet 64 on the first portion 52 of the first sheet 51, along the end edge 71, 72, to define the second coupling portion 14 inside the volume 3 of the container 1;

gluing the portion 65 of the fourth sheet 64 onto the first portion 52 of the first sheet 51;

folding the portion 69 of the fourth sheet 64 on the portion 65 of the same fourth sheet 64, along the folding edge 68, adapted to define the control portion 28.

According to the preferred manufacturing process, the previous three folding steps of the portion 65, gluing of the portion 65 and folding of the portion 69 are carried out by means of a technique whereby the order of the same steps is difficult to distinguish because the above steps are performed in almost synchronous manner.

The procedure also includes the following steps:

folding the first sheet 51, in particular the portions 52, 53, 54, 55 and 56 along the longitudinal connecting edges, to define the lateral walls 4 of the container 1 and the opening 5 of the container itself;

reciprocal gluing of the portions 55 and 56, to define the container 1 and the opening 5 of the container itself;

folding the fifth sheet 60 at 90° according to a direction entering the container 1 defining the support portions 11;

folding the second sheet 57 along the edges defining the portions 58 and 59, according to a direction entering the container 1, so as to define the closure portion 9 and the coupling portion 10 of the closure system 7;

folding the sixth sheet 80 along the edges defining the portions 81 and 82 according to a direction directed inside the container 1, to define the closure portion 209 carried by the free edge 6 and the coupling portion 210 of the occlusion system 207.

The order of execution of the two preceding folding steps of the second sheet 57 and folding of the sixth sheet 80 can be reversed.

The removable portion, at the end of the folding operations, is at least partly contained within the volume 3 of the container 1. The gluing takes place by applying a predetermined quantity of glue or adhesive material at the adhesion surfaces of the portions 65 and of the portions 55-56. The cutting of sheets 51, 57, 62, 64, 60 and 80 can be carried out advantageously but not limitedly in a single process, in particular a single shearing process can be carried out to define the semi-finished product 50 in FIG. 26.

As described above, the package may further include an opening device 160 which can be obtained by cutting a flat starting sheet, for example made of paper material.

Following the provision of case 102, container 1 and optionally of the opening device 160, it is possible to constrain case and container by inserting the latter into the internal volume 103. This constraint step includes the following steps:

positioning the lateral wall 4*d* of the container 1 at the opening 105 of the case, partially inserting the container 1 inside the volume 103 of the case 102 through the opening 105 of the case 102 itself, inserting the first coupling portion 307 of the case 102 inside the pocket 314 of the container 1 through the cu element 317, so as to activate the second operative position of the container 1, completing the insertion of the container 1 inside the case 102 so as to activate the first operative position.

The package 100 is therefore completed. The container 1 is stably protected inside the outer case 102, whereby the switching of the container 1 from the first to the second operative position must be performed by inserting the opening device 160 through the slit 150.

The invention claimed is:

1. A package, comprising:

a housing defining a first internal volume and comprising first lateral walls that define a first through opening further defined by a first edge;

a container defining a second internal volume and being configured for housing one or more products, the container comprising second lateral walls that define a second through opening further defined by a second edge, the second through opening being configured to permit insertion and withdrawal of the one or more products from the container, and the container being adjustable to:

a first configuration in which the container is at least partially disposed within the housing and in which the second through opening is at least partially disposed within the first internal volume, such that the one or more products are prevented from being inserted and withdrawn through said the second through opening, and a second configuration in which the container is at least partially disposed outside of the first internal volume and in which the second opening is defined outside of the first internal volume such that the second opening permits insertion and withdrawal of the one or more products from the container, the container being adjustable from the first configuration to the second configuration via an opening action of the housing;

a coupling system configured to secure the container to the housing, the coupling system comprising:

a first coupling portion carried by the housing, and a second coupling portion carried by the container, the second coupling portion being engaged with the first coupling portion in the first configuration of the container such that the container is prevented from being adjusted from the first configuration to the second configuration, and a thrusting element carried by the second coupling portion, the thrusting element being configured for maintaining an engagement between the first and second coupling portions while the container is in the first configuration, wherein the first coupling portion comprises a protrusion that extends from a lateral wall of the first lateral walls within the first internal volume, wherein the thrusting element is configured to move the protrusion of the first coupling portion towards the second coupling portion in a direction towards the second internal volume, and wherein the housing, the container, and the coupling system are made of sheet material.

2. The package according to claim 1, wherein the first coupling portion comprises a lateral stop element configured to define an undercut that is stably engaged with the second coupling portion while the container is in the first configuration.

3. The package according to claim 1, wherein the first coupling portion is integral with the housing, and wherein the second coupling portion is integral with the container.

4. The package according to claim 1, wherein the housing comprises a third through opening disposed opposite to the first through opening, wherein the third through opening is bordered by a third edge, wherein the first coupling portion is connected to the third edge, wherein the first coupling portion is integral with the third edge, and wherein the first coupling portion is folded with respect to the third edge inside of the housing.

5. The package according to claim 1, wherein the second coupling portion comprises a pocket defined on one lateral wall of the first and second lateral walls such that the pocket is configured to receive the first coupling portion while the container is in the first configuration, wherein the pocket is further defined by a closure edge that is configured to define an undercut that is securable to the first coupling portion while the container is in the first configuration for preventing the container from being adjusted from the first configuration to the second configuration.

6. The package according to claim 5, wherein the undercut defined by the closure edge engages a stop element of the first coupling portion while the container is in the first configuration.

7. The package according to claim 5, wherein the second coupling portion comprises a cut directly communicating with the pocket, wherein the cut is configured to permit disengagement of the first coupling portion from the second coupling portion to permit the container to be adjusted from the first configuration to the second configuration.

8. The package according to claim 5, wherein the pocket is further defined by a trailing edge directly connected to the closure edge, wherein the closure edge has a first width along a direction normal to an inserting direction of the first coupling portion into the pocket, and wherein the trailing edge has a second width along the direction normal to the inserting direction of the first coupling portion into the pocket that is greater than the first width.

9. The package according to claim 8, wherein the first lateral walls of the housing comprise a front wall and a rear wall facing and parallel to each other, wherein the front and rear walls are connected to and distanced from each other by first and second side walls of the first lateral walls that face and are parallel to each other, wherein the first coupling portion is carried by one or both of the front wall and the rear wall, and wherein the first coupling portion extends from one or both of the front wall and the rear wall inside of the first internal volume.

10. The package according to claim 9, wherein the second lateral walls of the container comprise a front wall and a rear wall facing and parallel to each other, wherein the front and rear walls are connected to and distanced from each other by first and second side walls that face and are parallel to each other, wherein the front and rear walls of the container respectively face the front and rear walls of the housing while the container is in the first configuration, wherein the second coupling portion is defined on the front wall of the container, and wherein the second coupling portion faces the front wall of the housing while the container is in the first configuration.

11. The package according to claim 10, wherein the thrusting element is carried by and integral with the front wall of the container, wherein the thrusting element is folded into the second internal volume of the container, wherein the thrusting element extends from the trailing edge along a direction transverse to the inserting direction of the first coupling portion into the pocket of the container, and wherein the thrusting element is folded around the trailing edge into the second internal volume of the container.

12. The package according to claim 1, further comprising a slit defined by one of the first and second lateral walls, wherein the slit is configured to permit insertion of an opening device while the container is in the first configuration, and wherein the opening device is configured to disengage the first and second coupling portions from each other in order to permit the container to be adjusted from the first configuration to the second configuration.

13. The package according to claim 1, wherein the first coupling portion comprises a first and second lateral stop elements that are spaced apart from each other, wherein the first lateral stop element is configured to define an undercut that is stably engageable with the second coupling portion while the container is in the second configuration to prevent the container from being completely extracted from the housing, wherein, in the second configuration, the container is at least partially disposed within the first internal volume of the housing.

14. The package according to claim 1, wherein the container comprises a closure system disposed along the second edge of the container and rotatable about the second edge of the second through opening of the container, wherein the closure system is configured to define a closed configuration in which the closure system substantially occludes the second through opening of the container and prevents the communication between the second internal volume and an outer environment that is external to the package, wherein the closure system is further configured to define an open configuration in which the closure system permits communication between the second internal volume and the outer environment, and wherein the closure system is made of sheet material.

15. A package, comprising:

a housing defining a first internal volume, the housing comprising first lateral walls that define a first through opening further defined by a first edge;

a container defining a second internal volume and being configured for housing one or more products, the container comprising second lateral walls defining a second through opening further defined by a second edge, the second through opening being configured to permit insertion and withdrawal of the one or more products from the container, and the container being adjustable to:

a first configuration in which the container is at least partially disposed within the housing and in which the second through opening of the container is at least partially defined within the first internal volume, such that the one or more products are prevented from being inserted and withdrawn through the second through opening, a second configuration in which the container is at least partially disposed outside of the first internal volume and in which the second through opening of the container is defined outside of the first internal volume such that the second through opening permits insertion and withdrawal of the one or more products from the container, the container being adjustable from the first configuration to the second configuration through the first through opening of the housing;

a coupling system configured to secure the container to the housing, the coupling system comprising:

a first coupling portion carried by one or both of the housing and the container, a second coupling portion carried by the other of the container and the housing, the second coupling portion being engaged with the first coupling portion in the first configuration of the container such that the container is prevented from being adjusted from the first configuration to the second configuration, and a thrusting element carried by one or both of the first and second coupling portions, the thrusting configured for maintaining an engagement between the first and second coupling portions while the container is in the first configuration, wherein the housing comprises a third through opening disposed opposite to the first through opening, wherein the third through opening is bordered by a third edge, wherein the first coupling portion is connected to the third edge, wherein the first coupling portion is integral with the third edge, and wherein the first coupling portion is folded with respect to the third edge inside of the housing, and wherein the housing, the container, and the coupling system are made of sheet material.

16. The package according to claim 15, wherein the first coupling portion comprises a protrusion extending from a lateral wall of the first and second lateral walls within the first internal volume, and wherein the thrusting element is configured to move the protrusion of the first coupling portion towards the second coupling portion in a direction towards the second internal volume.

17. The package according to the claim 15, wherein the first coupling portion comprises a lateral stop element configured to define an undercut that is stably engaged with the second coupling portion while the container is in the first configuration.

18. The package according to claim 15, wherein the first lateral walls of the housing comprise a front wall and a rear wall facing and parallel to each other, the front and rear walls being connected to and distanced from each other by first and second side walls that face and are parallel to each other, wherein the first coupling portion is carried by one or both of the front and rear walls, wherein the first coupling portion extends from one or both of the front and rear walls inside the first internal volume, wherein the second lateral walls of the container comprise a front wall and a rear wall facing and to each other, the front and rear walls being connected to and distanced from each other by first and second side walls that face and are parallel to each other, the front and rear walls of the container respectively facing the front and rear walls of the housing while the container is in the first configuration, wherein the second coupling portion is defined on the front wall of the container, wherein the second coupling portion faces the front wall of the housing while the container is in the first configuration, wherein the thrusting element is carried by the front wall of the container, and wherein the thrusting element is folded into the first internal volume of the container.

19. A package, comprising:

a housing defining a first internal volume, the housing comprising first lateral walls that define a first through opening further defined by a first edge;

a container defining a second internal volume, the container being configured for housing one or more products, the container comprising second lateral walls that define a second through opening further defined by second edge, said the second through opening being configured to permit insertion and withdrawal of the one or more products from the container, and the container being adjustable to:

a first configuration in which the container is at least partially disposed in the housing and in which the second through opening is at least partially defined inside of the first internal volume of the housing, such that the one or more products are prevented from being inserted and withdrawn through the second through opening, and a second configuration in which the container is at least partially disposed outside of the first internal volume and in which the second through opening is defined outside of the first internal volume such that the second through opening permits insertion and withdrawal of the one or more products from the container, the container being adjustable from the first configuration to the second configuration via an opening action of the housing, a coupling system configured to secure the container to the housing, the coupling system comprising:

a first coupling portion carried by the housing or the container, a second coupling portion carried by the other of the container and housing, the second coupling portion being engaged with the first coupling portion in the first configuration of the container such that the container is prevented from being adjusted from the first configuration to the second configuration, and a thrusting element carried by one or both of the first and second coupling portions, the thrusting element configured for maintaining an engagement between the first and second coupling portions at while the container is in the first configuration, wherein the first coupling portion comprises a first lateral stop element configured to define a first undercut that is stably engaged with the second coupling portion while the container is in the first configuration, wherein the first coupling portion comprises a second lateral stop element that is spaced from the first lateral stop element and that is configured to define second undercut that is stably engageable with the second coupling portion while the container is in the second configuration for preventing the container from being completely extracted from the housing, and wherein the housing, the container, and the coupling system are made of sheet material.

20. The package according to claim 19, wherein the second coupling portion comprises a pocket defined on one lateral wall of the first and second lateral walls, wherein the pocket is configured to receive the first coupling portion while the container is in the first configuration, wherein the pocket is further defined by a closure edge that is configured to define an additional undercut that is configured to be secured to the first coupling portion while the container is in the first configuration to prevent the container from being adjusted from the first configuration to the second configuration, wherein the additional undercut engages the first lateral stop element of the first coupling portion at least while the container is in the first configuration, wherein the second coupling portion comprises a cut directly communicating with the pocket, and wherein the cut is configured to permit disengagement of the first coupling portion from the second coupling portion to permit the container to be adjusted from the first configuration to the second configuration.

21. The package according to the claim 19, wherein the first coupling portion comprises a protrusion that extends from a lateral wall of the first and second lateral walls within the first internal volume, wherein the thrusting element is configured to move the protrusion of the first coupling portion towards the second coupling portion and towards the second internal volume of the container.

* * * * *